US010839748B2

(12) United States Patent
Kim et al.

(10) Patent No.: US 10,839,748 B2
(45) Date of Patent: Nov. 17, 2020

(54) LIGHT EMITTING DISPLAY APPARATUS

(71) Applicant: LG Display Co., Ltd., Seoul (KR)

(72) Inventors: Taegung Kim, Osan-si (KR); Kyung-Rok Kim, Osan-si (KR); SeungTae Kim, Osan-si (KR)

(73) Assignee: LG DISPLAY CO., LTD., Seoul (KR)

( * ) Notice: Subject to any disclaimer, the term of this patent is extended or adjusted under 35 U.S.C. 154(b) by 51 days.

(21) Appl. No.: 16/226,153

(22) Filed: Dec. 19, 2018

(65) Prior Publication Data

US 2019/0206319 A1 Jul. 4, 2019

(30) Foreign Application Priority Data

Dec. 29, 2017 (KR) ..... 10-2017-0184840

(51) Int. Cl.
*G09G 3/3233* (2016.01)
*G09G 3/32* (2016.01)

(52) U.S. Cl.
CPC ..... *G09G 3/3233* (2013.01); *G09G 3/32* (2013.01); *G09G 2310/027* (2013.01); *G09G 2310/0297* (2013.01)

(58) Field of Classification Search
CPC ..... G09G 3/3233; G09G 3/2022; G09G 3/32; G09G 2300/0804; G09G 2300/0814; G09G 2300/0452; G09G 2300/0842; G09G 2310/0297; G09G 2310/027; G09G 2310/0235; G09G 2310/06; H05B 45/37; H05B 45/46
See application file for complete search history.

(56) References Cited

U.S. PATENT DOCUMENTS 6,618,031 B1 * 9/2003 Bohn, Jr. ..... H05B 45/37 345/83
2005/0200617 A1 * 9/2005 Kwak ..... H05B 45/37 345/204
2006/0139257 A1 6/2006 Kwak et al.
2016/0372043 A1 12/2016 Yamanaka
2019/0206324 A1 * 7/2019 Kim ..... H01L 27/3276
2019/0221151 A1 * 7/2019 Nakao ..... G09G 3/2003

FOREIGN PATENT DOCUMENTS

EP 1538594 A2 6/2005
EP 1628285 A1 2/2006

* cited by examiner

*Primary Examiner* — Christopher E Leiby
(74) *Attorney, Agent, or Firm* — Polsinelli PC

(57) ABSTRACT

Disclosed is a light emitting display apparatus. The light emitting display apparatus includes a plurality of pixels provided in a display area of a substrate and connected to a data line, a clock line, and a pixel driving power line. The plurality of pixels each include a pixel driving chip connected to the data line, the clock line, and the pixel driving power line to sequentially output a driving current through a plurality of output terminals thereof and a plurality of light emitting devices respectively connected to the plurality of output terminals, and the plurality of light emitting devices respectively and sequentially receive the driving current through the plurality of output terminals to emit light of different colors. Accordingly, light having a plurality of colors are respectively emitted in subfields of a unit frame, thereby preventing the occurrence of color breaking.

21 Claims, 10 Drawing Sheets

LIGHT EMITTING DISPLAY APPARATUS

CROSS REFERENCE TO RELATED APPLICATION

This application claims the benefit of the Korean Patent Application No. 10-2017-0184840 filed on Dec. 29, 2017, which is hereby incorporated by reference in its entirety as if fully set forth herein.

BACKGROUND

Field of the Disclosure

The present disclosure relates to a display device, and more particularly, to a light emitting display apparatus. Although the present disclosure is suitable for a wide scope of applications, it is particularly suitable for preventing a color breaking phenomenon in the light emitting display apparatus.

Description of the Background

Recently, with the advancement of multimedia, the importance of display apparatuses is increasing. Therefore, flat panel display apparatuses such as liquid crystal display (LCD) apparatuses, organic light emitting display apparatuses, and light emitting diode display apparatuses have been commercialized. The LCD apparatuses and the organic light emitting display apparatuses among the flat panel display apparatuses have good characteristics such as thinness, lightness, and low power consumption, and thus, are being widely used as a display screen for televisions (TVs), notebook computers, and monitors as well as portable electronic devices such as electronic notebooks, e-books, portable multimedia players (PMPs), navigation devices, ultra-mobile personal computers (PCs), mobile phones, smartphones, smartwatches, tablet personal computers (PCs), watch phones, and mobile communication terminals.

A plurality of pixels of a related art light emitting display apparatus emit red light, green light, and blue light in each of subfields of a unit frame. In this case, the subfields of the unit frame sequentially emit the red light, the green light, and the blue light, and thus, one subfield cannot emit light having a plurality of colors. That is, each of the subfields may emit light having only one color of red, green, and blue. For this reason, whenever light is emitted in each subfield of the unit frame, colors of light are all converted, and due to this, a color breaking phenomenon occurs, causing the reduction in visibility.

SUMMARY

Accordingly, the present disclosure is directed to providing a light emitting display apparatus that substantially obviates one or more problems due to limitations and disadvantages of the related art.

An aspect of the present disclosure is directed to providing a light emitting display apparatus in which the light emitting display apparatus includes a pixel driving chip for sequentially outputting a driving current through a plurality of output terminals, and thus, light having a plurality of colors are respectively emitted in subfields of a unit frame, thereby preventing the occurrence of a color breaking phenomenon.

Another aspect of the present disclosure is directed to providing a light emitting display apparatus which includes a pixel driving chip for alternately supplying a driving current to a plurality of light emitting devices in each of subfields of a unit frame, thereby preventing the occurrence of a color breaking phenomenon.

Another aspect of the present disclosure is directed to providing a light emitting display apparatus in which a plurality of light emitting devices respectively emits light having a plurality of colors in subfields of a unit frame, thereby enhancing a response time of an image.

Another aspect of the present disclosure is directed to providing a light emitting display apparatus in which a pixel driving chip including one amplifier drives a plurality of light emitting devices, thereby reducing the manufacturing cost of the light emitting display apparatus.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a light emitting display apparatus including a plurality of pixels provided in a display area of a substrate and connected to a data line, a clock line, and a pixel driving power line, wherein the plurality of pixels each include a pixel driving chip connected to the data line, the clock line, and the pixel driving power line to sequentially output a driving current through a plurality of output terminals thereof and a plurality of light emitting devices respectively connected to the plurality of output terminals, and the plurality of light emitting devices respectively and sequentially receive the driving current through the plurality of output terminals to emit light of different colors.

In another aspect of the present disclosure, a light emitting display apparatus includes a plurality of pixels disposed in a display area; a pixel driving chip disposed in each pixel and connected to a data line, a clock line and a pixel driving power line, and sequentially outputting a driving current through a plurality of output terminals of each pixel; and a plurality of light emitting devices respectively connected to the plurality of output terminals and sequentially receiving the driving current through the plurality of output terminals to emit light of different colors in each subfield within a unit frame.

Details of other aspects are included in the detailed description and the drawings.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principle of the disclosure.

In the drawings.

DETAILED DESCRIPTION OF THE DISCLOSURE

Figure 1:
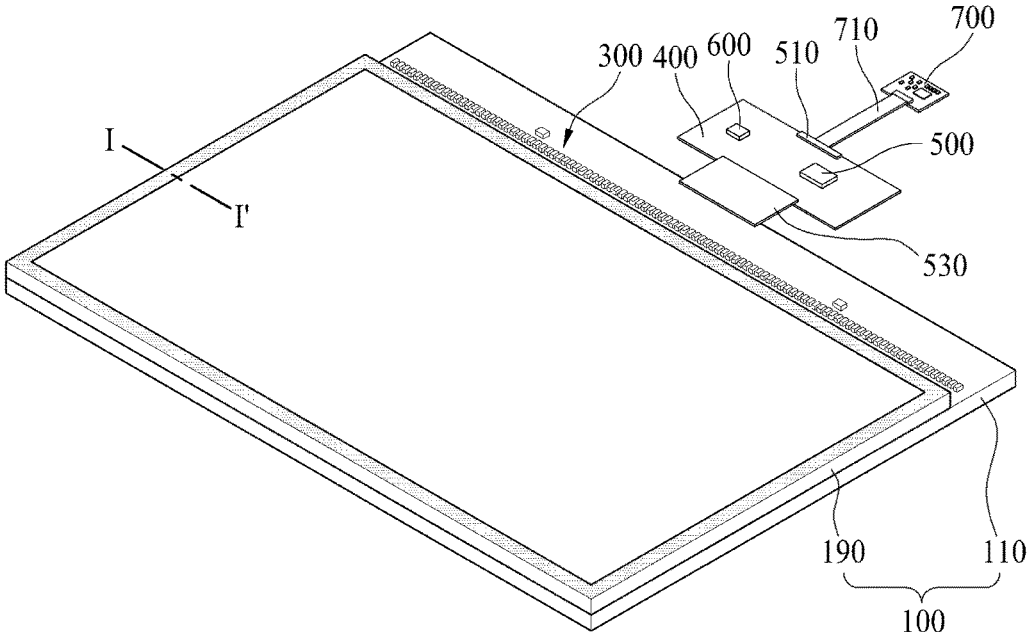
FIG. 1 is a diagram illustrating a light emitting display apparatus according to an aspect of the present disclosure.

Reference will now be made in detail to the exemplary aspects of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing aspects of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~' and 'next~', one or more other parts may be disposed between the two parts unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms "first", "second", etc. may be used. The terms are merely for differentiating one element from another element, and the essence, sequence, order, or number of a corresponding element should not be limited by the terms. It will be understood that when an element or layer is described as being "connected", "coupled", or "adhered" to another element or layer, the element or layer can be directly connected or adhered to the other element or layer, but the other element or layer can be "disposed" between elements or layers, or elements or layers can be "connected", "coupled", or "adhered" to each other through the other element or layer.

Features of various aspects of the present disclosure may be partially or overall coupled to or combined with each other, and may be variously inter-operated with each other and driven technically as those skilled in the art can sufficiently understand. The aspects of the present disclosure may be carried out independently from each other, or may be carried out together in co-dependent relationship.

Hereinafter, aspects of the present disclosure will be described in detail with reference to the accompanying drawings.

Figure 2:
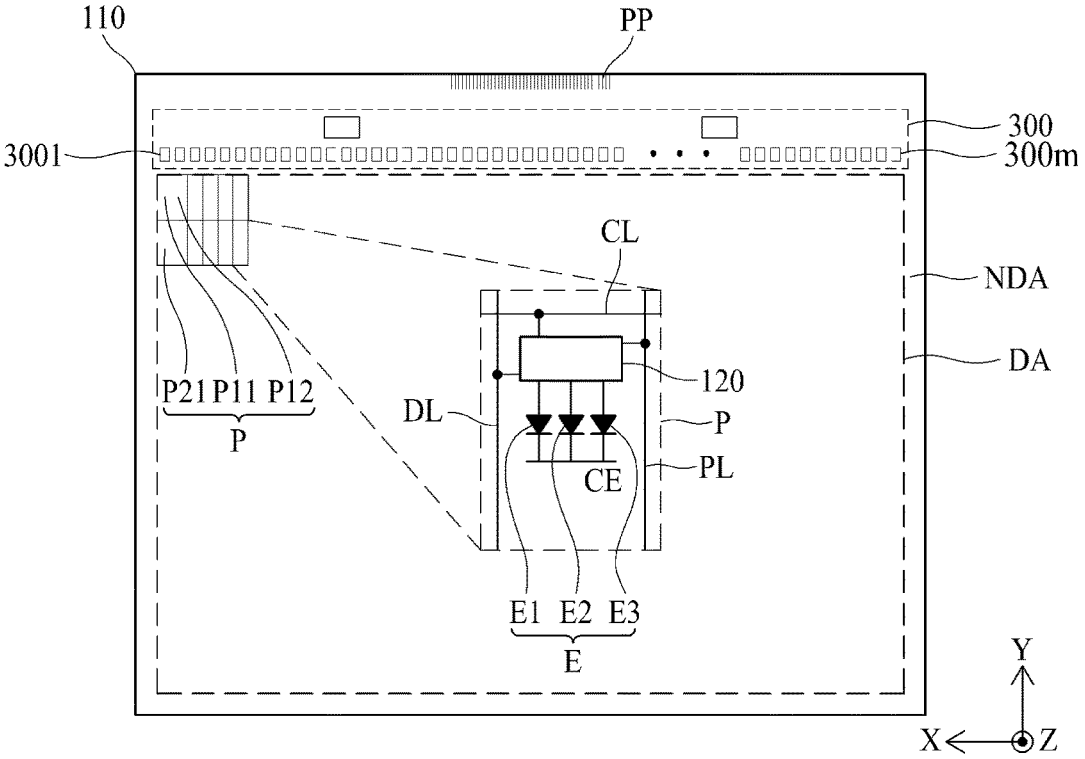
FIG. 2 is a plan view illustrating a substrate illustrated in FIG. 1.
Figure 3:
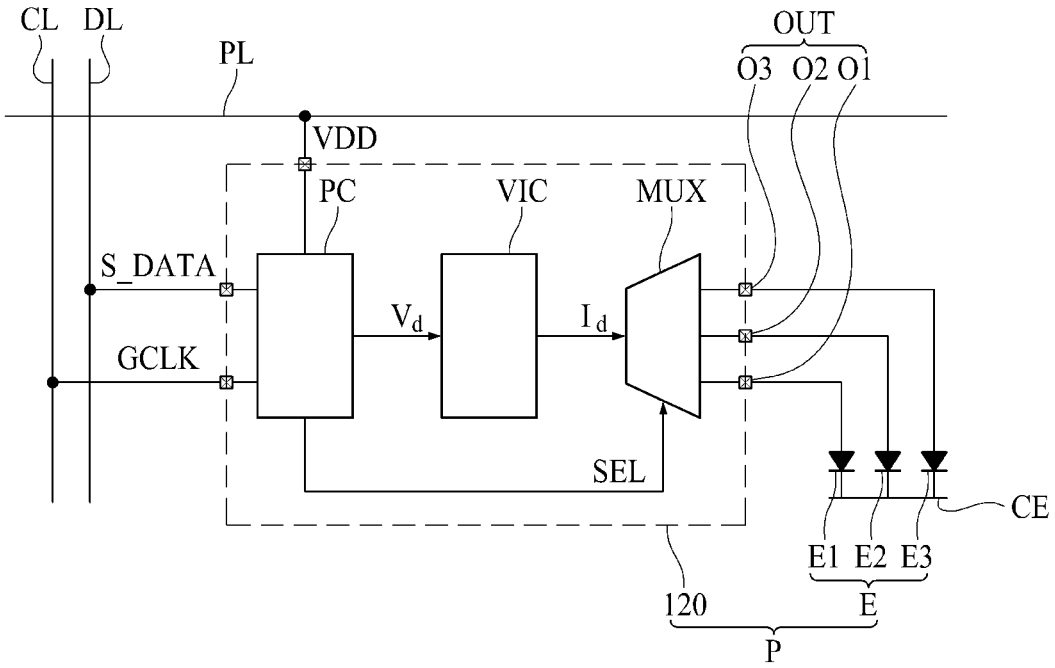
FIG. 3 is a diagram illustrating one pixel illustrated in FIG. 2.
Figure 4:
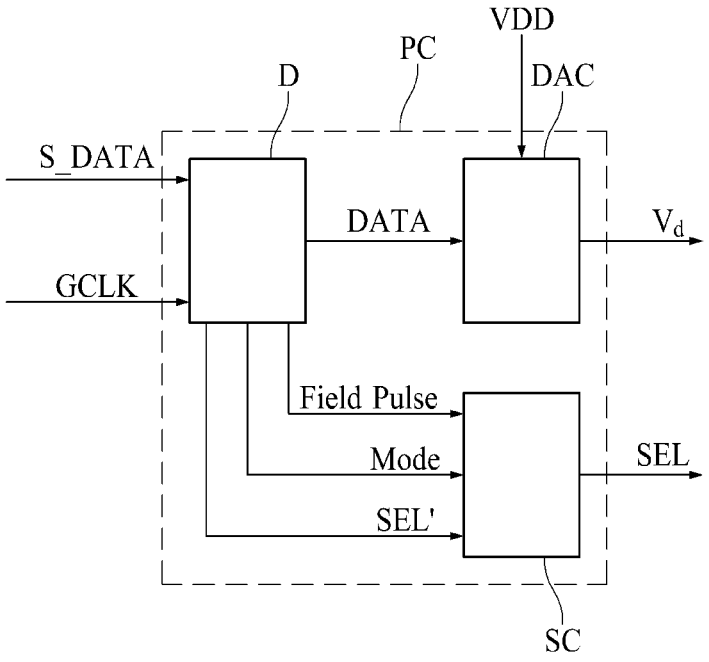
FIG. 4 is a diagram illustrating a pixel driving circuit illustrated in FIG. 3.

FIG. 1 is a diagram illustrating a light emitting display apparatus according to an aspect of the present disclosure. FIG. 2 is a plan view illustrating a substrate illustrated in FIG. 1. FIG. 3 is a diagram illustrating one pixel illustrated in FIG. 2. FIG. 4 is a diagram illustrating a pixel driving circuit illustrated in FIG. 3.

Referring to FIGS. 1 to 4, the light emitting display apparatus according to an aspect of the present disclosure may include a display panel 100 and a data driving chip array part 300 mounted on the display panel 100.

The display panel 100 may include a substrate 110 and an opposite substrate 190, which face each other. Here, the substrate 110 may be a pixel array substrate, and the opposite substrate 190 may be a color filter array substrate including a color filter. Also, the substrate 110 may have a size which is larger than that of the opposite substrate 190, and thus, one edge of the substrate 110 may be exposed without being covered by the opposite substrate 190.

The substrate 110, a base substrate, may be formed of an insulating material such as glass, quartz, ceramic, or plastic. For example, the substrate 110 including plastic may be a polyimide film, and particularly, may be a heat-resistant polyimide film capable of enduring a high temperature in a high temperature deposition process. The substrate 110 may include a display area DA including a plurality of pixel areas and a non-display area NDA. The display area DA may be defined as an area which displays an image, and the non-display area NDA may be an area which does not display an image and may be defined in an edge of the substrate 110 to surround the display area DA.

According to an aspect, the substrate 110 may include first to $m^{th}$ clock lines CL passing through the display area DA in a first direction X and first to $m^{th}$ data lines DL passing through the display area DA in a second direction Y intersecting the first direction X. Also, the substrate 110 may include first to $m^{th}$ pixel driving power lines PL parallel to the first to $m^{th}$ data lines DL. The first to $m^{th}$ clock lines CL and the first to $m^{th}$ data lines DL may intersect one another to define a plurality of pixel areas in the display area DA.

According to an aspect, the substrate 110 may include a plurality of pixels P for displaying an image. The plurality of pixels P may each include a pixel driving chip 120 and a plurality of light emitting devices E.

The pixel driving chip 120 may be provided in each of the plurality of pixel areas, connected to an adjacent clock line CL, an adjacent data line DL, and an adjacent pixel driving power line PL, and connected to the plurality of light emitting devices E through a plurality of output terminals OUT. According to an aspect, the pixel driving chip 120 may be a minimum-unit microchip or one chipset and may be a semiconductor packaging device which includes a plurality of transistors and at least one capacitor and has a fine size.

The pixel driving chip 120 may sequentially output a driving current Id through the plurality of output terminals OUT. In detail, the pixel driving chip 120 may select an output terminal OUT, through which the driving current Id is to be output, from among the plurality of output terminals OUT in each of subfields of a unit frame. According to an aspect, the pixel driving chip 120 may alternately supply the driving current Id to the plurality of light emitting devices E respectively connected to the plurality of output terminals OUT in each of subfields of a unit frame. Therefore, the pixel driving chip 120 may time-divisionally drive first to third light emitting devices E1 to E3 in the unit frame to prevent a color breaking phenomenon, thereby enhancing a response time of an image. For example, the pixel driving chip 120 may include first to third output terminals O1 to O3 respectively connected to the first to third light emitting devices E1 to E3.

The plurality of light emitting devices E may respectively and sequentially receive the driving current Id through the plurality of output terminals OUT to emit light of different colors during a unit frame. According to an aspect, the plurality of light emitting devices E may include the first to third light emitting devices E1 to E3 respectively connected to the first to third output terminals O1 to O3 of the pixel driving chip 120. Here, each of the first to third light emitting devices E1 to E3 may emit one of red light, green light, and blue light. For example, the first light emitting device E1 may receive the driving current Id through the first output terminal O1 to emit red light during a first subfield of the unit frame. Also, the third light emitting device E3 may receive the driving current Id through the third output terminal O3 to emit blue light during a second subfield of the unit frame. Also, the second light emitting device E2 may receive the driving current Id through the second output terminal O2 to emit green light during a third subfield of the unit frame. As described above, the light emitting display apparatus may alternately supply the driving current Id to the plurality of light emitting devices E in each of the subfields of the unit frame, thereby preventing the occurrence of the color breaking phenomenon. Here, the color breaking phenomenon may be referred to as a rainbow phenomenon and may denote a phenomenon where colors displayed by the display panel 100 are mixed to instantaneously cause noise such as rainbow. That is, the color breaking phenomenon causes adverse visibility to decrease a visibility of a viewer who is watching an image. Accordingly, the light emitting display apparatus according to the present disclosure prevents the occurrence of the color breaking phenomenon, thereby providing sharp visibility of the light emitting display apparatus.

According to an aspect, the pixel driving chip 120 of each of adjacent pixels P of the plurality of pixels P may output the driving current Id through different output terminals. In detail, each of the plurality of pixels P may include the first to third light emitting devices E1 to E3 which are arranged in parallel in the first direction X. That is, a third light emitting device E3 of a 1-$1^{th}$ pixel P11 and a first light emitting device E1 of a 1-$2^{th}$ pixel P12 may be disposed adjacent to each other. For example, when a pixel driving chip 120 of the 1-$1^{th}$ pixel P11 outputs the driving current Id through a third output terminal O3 thereof, a pixel driving chip 120 of the 1-$2^{th}$ pixel P12 may output the driving current Id through a second output terminal O2 thereof. Also, when the pixel driving chip 120 of the 1-$2^{th}$ pixel P12 outputs the driving current Id through a first output terminal O1 thereof, the pixel driving chip 120 of the 1-$1^{th}$ pixel P11 may output the driving current Id through a second output terminal O2 thereof. Accordingly, the third light emitting device E3 of the 1-$1^{th}$ pixel P11 and the first light emitting device E1 of the 1-$2^{th}$ pixel P12 which are adjacent to each other may not simultaneously emit light, thereby preventing the occurrence of the color breaking phenomenon.

First to third light emitting devices E1 to E3 of the 1-$1^{th}$ pixel P11 may be respectively disposed adjacent to first to third light emitting devices E1 to E3 of a 2-$1^{th}$ pixel P21. For example, when the pixel driving chip 120 of the 1-$1^{th}$ pixel P11 outputs the driving current Id through a first output terminal O1 thereof, a pixel driving chip 120 of the 2-$1^{th}$ pixel P21 may output the driving current Id through the second output terminal O2 thereof. Also, when the pixel driving chip 120 of the 1-$1^{th}$ pixel P11 outputs the driving current Id through a second output terminal O2 thereof, the pixel driving chip 120 of the 2-$1^{th}$ pixel P21 may output the driving current Id through a third output terminal O3 thereof. Also, when the pixel driving chip 120 of the 1-$1^{th}$ pixel P11 outputs the driving current Id through the third output terminal O3 thereof, the pixel driving chip 120 of the 2-$1^{th}$ pixel P21 may output the driving current Id through a first output terminal O1 thereof. Accordingly, each of the first to third light emitting devices E1 to E3 of the 1-$1^{th}$ pixel P11 and a corresponding light emitting device of the first to third light emitting devices E1 to E3 of the 2-$1^{th}$ pixel P21, which are adjacent to each other, may not simultaneously emit light, thereby preventing the occurrence of the color breaking phenomenon.

According to an aspect, each of adjacent pixels P of the plurality of pixels P may select one output terminal OUT from among a plurality of output terminals OUT in different orders during a unit frame and may output the driving current Id through the selected one output terminal OUT.

According to an aspect, when a light emitting device E of an adjacent pixel P emits light, the pixel driving chip 120 of each of the plurality of pixels P may supply the driving current Id to a light emitting device E spaced apart from the light emitting device E of the adjacent pixel P.

The pixel driving chip 120 may include a pixel driving circuit PC, a driving current generator VIC, and a multiplexer MUX.

The pixel driving circuit PC may be connected to a data line DL, a clock line CL, and a pixel driving power line PL and may output a driving voltage Vd and a cell signal SEL. In detail, the pixel driving circuit PC may receive a serial data signal S_DATA through the data line DL, receive a reference clock signal GCLK through the clock line CL, and receive a pixel driving voltage VDD through the pixel driving power line PL. According to an aspect, the serial data signal S_DATA may include data information and cell information. Also, the data information included in the serial data signal S_DATA may be implemented as digital or analog information. Here, the data information may be used to determine a luminance of light emitted from each of the plurality of light emitting devices E, and the cell information may be used to determine one light emitting device E, to which the driving current Id is supplied, from among the plurality of light emitting devices E. Therefore, the pixel driving circuit PC may supply the driving current generator VIC with the driving voltage Vd generated based on the data information included in the serial data signal S_DATA and may supply the multiplexer MUX with the cell signal SEL generated based on the cell information included in the serial data signal S_DATA. As described above, in the light emitting display apparatus according to the present disclosure, the pixel driving circuit PC may receive the serial data signal S_DATA, the reference clock signal GCLK, and the pixel driving voltage VDD to output the driving voltage Vd and the cell signal SEL, and thus, one pixel driving chip 120 may driving the plurality of light emitting devices E. That is, in the light emitting display apparatus including the pixel driving chip 120, the number of pixel driving chips 120 mounted on the substrate may decrease by a factor of ⅓, and a mount process time taken in mounting the pixel driving chips 120 may decrease, thereby reducing the manufacturing cost and reliability of the light emitting display apparatus.

According to an aspect, the pixel driving chip 120 may determine the order of output terminals OUT through which the driving current Id is output, based in the cell information included in the serial data signal S_DATA. For example, the pixel driving chip 120 may receive the serial data signal S_DATA including the cell information consisting of 2 bits for sequentially supplying the driving current Id to the first to third output terminals O1 to O3. Here, the cell information included in the serial data signal S_DATA may include a digital value corresponding to each of the plurality of output terminals OUT. According to an aspect, the cell information included in the serial data signal S_DATA may be received along with the data information, or may be received before the data information is received. Therefore, in the light emitting display apparatus according to the present disclosure, since the pixel driving chip 120 receives the serial data signal S_DATA including the cell information, one pixel driving chip 120 including one amplifier may sequentially drive the plurality of light emitting devices E. That is, in the light emitting display apparatus including the pixel driving chip 120, the number of pixel driving chips 120 mounted on the substrate may decrease by a factor of ⅓, and a mount process time taken in mounting the pixel driving chips 120 may decrease, thereby reducing the manufacturing cost and reliability of the light emitting display apparatus.

The driving current generator VIC may convert the driving voltage Vd into the driving current Id and may supply the driving current Id to the multiplexer MUX. According to an aspect, the driving current generator VIC may be implemented with a voltage-to-current converter and may further include one amplifier.

According to another aspect, the driving current generator VIC may supply the multiplexer MUX with the driving voltage Vd received from the pixel driving circuit PC, but in order to stably drive the plurality of light emitting devices E, the driving current generator VIC may convert the driving voltage Vd into the driving current Id.

The multiplexer MUX may sequentially select corresponding output terminals from among the plurality of output terminals OUT, based on the cell signal SEL and may output the driving current Id through the selected output terminal. In detail, the multiplexer MUX may receive the driving current Id from the driving current generator VIC and may receive the cell signal SEL from the pixel driving circuit PC, thereby outputting the driving current Id through one of the plurality of output terminals OUT. According to an aspect, the pixel driving circuit PC may generate the cell signal SEL from the serial data signal S_DATA including the cell information and may supply the cell signal SEL to the multiplexer MUX. Here, the cell signal SEL may include a digital value corresponding to each of the plurality of output terminals OUT. Therefore, the multiplexer MUX may transmit the driving current Id, received from the driving current generator VIC, to one of the plurality of light emitting devices E, and the plurality of light emitting devices E may sequentially receive the driving current Id from the pixel driving chip 120 to emit light of different colors during a unit frame, based on the serial data signal S_DATA including the cell information. As a result, in the light emitting display apparatus according to the present disclosure, one pixel driving chip 120 may sequentially drive the plurality of light emitting devices E.

The pixel driving circuit PC may include a decoder D, a digital-to-analog converter DAC, and a cell signal controller SC.

The decoder D may be connected to the clock line CL and may output a data signal DATA and an input cell signal SEL'. In detail, the decoder D may receive the serial data signal S_DATA through the data line DL and may receive the reference clock signal GCLK through the clock line CL. Also, the decoder D may supply the data signal DATA to the digital-to-analog converter DAC, based on the serial data signal S_DATA and the reference clock signal GCLK and may supply the input cell signal SEL' to the cell signal controller SC.

According to an aspect, the decoder D may supply a mode signal Mode to the cell signal controller SC. In detail, the pixel driving chip 120 may be driven in a first mode or a second mode. Here, the pixel driving chip 120 based on the first mode may receive the serial data signal S_DATA including digital data information and digital cell information to drive each of the plurality of pixels P in real time. For example, the serial data signal S_DATA based on the first mode may include the data information consisting of 8 bits and the cell information consisting of 2 bits. Here, a minimum number of bits for adding the cell information in each of subfields of a unit frame may be added to the serial data signal S_DATA based on the first mode. Therefore, the pixel driving chip 120 based on the first mode may receive the serial data signal S_DATA consisting of 10 bits in each subfield of the unit frame.

Moreover, the pixel driving chip 120 based on the second mode may previously receive the serial data signal S_DATA including only the cell information before each of the plurality of pixels P is driven (powered on) and may receive the serial data signal S_DATA including only the data information while driving each of the plurality of pixels P, thereby driving each of the plurality of pixels P. For example, the pixel driving chip 120 based on the second mode may previously receive the serial data signal S_DATA including only the cell information consisting of 2 bits before each of the plurality of pixels P is driven (powered on) and may receive the serial data signal S_DATA including only the data information while driving each of the plurality of pixels P. Therefore, since it is not required to add a bit for adding the cell information in each subfield of the unit frame, the pixel driving chip 120 based on the second mode may reduce a bandwidth of the serial data signal S_DATA. Accordingly, the pixel driving chip 120 based on the second mode may previously receive the serial data signal S_DATA including only the cell information, thereby more reducing a bandwidth than the first mode.

According to an aspect, the pixel driving circuit PC may further include a cell information storage unit which stores the cell information included in the serial data signal S_DATA which is previously received in the second mode. Here, the cell information storage unit may be implemented with a memory latch and may be embedded into the decoder D or the cell signal controller SC. For example, in a case where the cell information storage unit is embedded into the decoder D, the cell information storage unit may store the cell information included in previously received the serial data signal S_DATA, and then, may supply the input cell signal SEL' to the cell signal controller SC when driving a corresponding pixel P, based on the cell information. As another example, in a case where the cell information storage unit is embedded into the cell signal controller SC, the cell information storage unit may store the cell information included in previously received the serial data signal S_DATA, and then, may generate and output a cell signal SEL when driving a corresponding pixel P, based on the cell information.

The digital-to-analog converter DAC may be connected to the decoder D and the pixel driving power line PL and may output the driving voltage Vd. In detail, the digital-to-analog converter DAC may receive a digital data signal DATA from the decoder D and may receive an analog pixel driving voltage VDD through the pixel driving power line PL, thereby outputting an analog driving voltage Vd. That is, the digital-to-analog converter DAC may drop the pixel driving voltage VDD, based on a digital value of the data signal DATA. In this manner, the digital value of the data signal DATA may be used to determine a luminance of light emitted from each of the plurality of light emitting devices E.

The cell signal controller SC may receive the cell signal SEL from the decoder D and may supply the cell signal SEL to the multiplexer MUX. In detail, the cell signal controller SC may receive the input cell signal SEL' from the decoder D to output the cell signal SEL. Also, the cell signal controller SC may receive the mode signal Mode and may be driven in the first mode or the second mode.

Moreover, the pixel driving chip 120 based on the second mode may additionally receive a field pulse signal Field Pulse. In detail, the cell signal controller SC may output the cell signal SEL in a predetermined order, based on the field pulse signal Field Pulse. For example, when a unit frame includes three subfields, the field pulse signal Field Pulse may have three pulses per unit frame, and thus, may be divided into first to third subfields. Therefore, the cell signal controller SC may output the cell signal SEL in each of the first to third subfields, based on the field pulse signal Field Pulse, and thus, the multiplexer MUX may match pre-stored cell information with data information received in real time and may sequentially select corresponding output terminals from among the plurality of output terminals OUT.

According to an aspect, the decoder D of the pixel driving chip 120 based on the second mode may generate the field pulse signal Field Pulse from the reference clock signal GCLK and may supply the field pulse signal Field Pulse to the cell signal controller SC, and the cell signal controller SC may output the cell signal SEL changed in a predetermined order, based on the field pulse signal Field Pulse. For example, the decoder D may count the reference clock signal GCLK to generate the field pulse signal Field Pulse which is used to divide the first to third subfields of the unit frame. Therefore, the cell signal controller SC may generate different cell signals respectively corresponding to the subfields of the unit frame, based on the field pulse signal Field Pulse and the input cell signal SEL' and may supply a corresponding cell signal to the multiplexer MUX in each subfield.

According to an aspect, the decoder D of the pixel driving chip 120 based on the first mode may receive the serial data signal S_DATA including the data information and the cell information in each subfield of the unit frame and may drive each of the plurality of pixels P in real time. In this case, the decoder D may supply the input cell signal SEL' to the cell signal controller SC in each subfield of the unit frame, based on the serial data signal S_DATA including the data information and the cell information. Therefore, the cell signal controller SC of the pixel driving chip 120 based on the first mode may output the input cell signal SEL' as the cell signal SEL.

According to another aspect, the decoder D of the pixel driving chip 120 based on the second mode may previously receive the serial data signal S_DATA including only the cell information before each of the plurality of pixels P is driven and may receive the serial data signal S_DATA including only the data information while driving each of the plurality of pixels P, thereby driving each of the plurality of pixels P. At this time, the cell signal controller SC may receive the stored cell information from the cell information storage unit to generate the cell signal SEL.

Moreover, the cell signal controller SC of the pixel driving chip 120 based on the second mode may output different cell signals SEL respectively corresponding to the subfields of the unit frame, based on the pre-stored cell information. In detail, the cell information storage unit of the pixel driving chip 120 based on the second mode may store one piece of cell information per one pixel P. That is, the input cell signal SEL' of the pixel driving chip 120 based on the second mode may include one piece of cell information per one pixel P, and thus, in order to output the different cell signals SEL respectively corresponding to the subfields, the cell signal controller SC may output the cell signal SEL corresponding to a predetermined order, based on the input cell signal SEL'. For example, when the input cell signal SEL' corresponds to a 2-bit signal [00], the cell signal controller SC may output a 2-bit cell signal SEL in the order of [00], [10], and [01]. In this manner, when the input cell signal SEL' corresponds to a 2-bit signal [01], the cell signal controller SC may output a 2-bit cell signal SEL in the order of [01], [00], and [10], and when the input cell signal SEL' corresponds to a 2-bit signal [10], the cell signal controller SC may output a 2-bit cell signal SEL in the order of [10], [01], and [00]. As described above, when only one piece of cell information is provided per unit frame, the cell signal controller SC may output the cell signal SEL changed for each subfield in a predetermined order, thereby decreasing a bandwidth of the serial data signal S_DATA.

For example, when the cell signal SEL corresponds to a 2-bit signal [00], the multiplexer MUX may supply the driving current Id to the first output terminal O1. Also, when the cell signal SEL corresponds to a 2-bit signal [01], the multiplexer MUX may supply the driving current Id to the second output terminal O2, and when the cell signal SEL corresponds to a 2-bit signal [10], the multiplexer MUX may supply the driving current Id to the third output terminal O3. Additionally, when the cell signal SEL corresponds to a 2-bit signal [11], the multiplexer MUX may supply the driving current Id to the first to third output terminals O1 to O3. At this time, each of the first to third light emitting devices E1 to E3 respectively connected to the first to third output terminals O1 to O3 may emit one of red light, green light, and blue light.

The plurality of light emitting devices E may emit light with the driving current Id supplied from the pixel driving chip 120. According to an aspect, the light emitted from the plurality of light emitting devices E may be output to the outside through the opposite substrate 190, or may be output to the outside through the substrate 110.

According to an aspect, the plurality of light emitting devices E may include an anode electrode (or a first electrode) connected to a corresponding pixel driving chip 120, a light emitting layer connected to the anode electrode, and a cathode electrode (or a second electrode) CE connected to the light emitting layer. The light emitting layer may include one of an organic light emitting layer, an inorganic light emitting layer, and a quantum dot light emitting layer, or may include a stacked or mixed structure including an organic light emitting layer (or an inorganic light emitting layer) a quantum dot light emitting layer.

The opposite substrate 190 may cover the plurality of pixels P provided on the substrate 110. For example, the opposite substrate 190 may be a glass substrate, a flexible substrate, a plastic film, or the like. Also, the opposite substrate 190 may be a polyethylene terephthalate film, a polyimide film, or the like. The opposite substrate 190 may be bonded to the substrate 110 by a transparent adhesive layer.

The data driving chip array part 300 may be provided in the non-display area NDA of the substrate 110 and may be connected to the first to $m^{th}$ data lines DL. In detail, the data driving chip array part 300 may convert a data signal, supplied through a pad part PP disposed in a first non-display area (or an upper non-display area) of the substrate 110, into a data voltage and may supply the data voltage to a corresponding data line of the first to $m^{th}$ data lines DL. For example, the data driving chip array part 300 may include a plurality of data driving chips for respectively supplying data voltages to the first to $m^{th}$ data lines DL.

According to an aspect, the light emitting display apparatus may further include a control board 400, a timing controller 500, a power management circuit 600, and a display driving system 700.

The control board 400 may be connected to, through a signal cable 530, the pad part PP disposed in one non-display area of the substrate 110.

The timing controller 500 may be mounted on the control board 400. The timing controller 500 may perform signal processing on an image signal input thereto to generate a digital data signal and may supply the digital data signal to the data driving chip array part 300. That is, the timing controller 500 may receive the image signal and a timing synchronization signal supplied from the display driving system 700 through a user connector 510 provided on the control board 400. The timing controller 500 may align the image signal to generate the digital data signal matching a pixel arrangement structure of the display area DA, based on the timing synchronization signal and may supply the generated digital data signal to the data driving chip array part 300. According to an aspect, the timing controller 500 may supply the digital data signal, a reference clock, and a data start signal to the data driving chip array part 300 by using a high speed serial interface manner (for example, an embedded point to point interface (EPI) manner, a low-voltage differential signaling (LVDS) interface manner, or a mini LVDS interface manner).

Moreover, the timing controller 500 may generate the reference clock and the data start signal, based on the timing synchronization signal and may supply the reference clock and the data start signal to the data driving chip array part 300.

The power management circuit 600 may generate a transistor logic voltage, a ground voltage, a pixel driving voltage, and a plurality of reference gamma voltages, based on an input power supplied from a power supply of the display driving system 700. Each of the transistor logic voltage and the ground voltage may be used as a driving voltage for the timing controller 500 and the data driving chip array part 300, and the ground voltage and the pixel driving voltage may be applied to the data driving chip array part 300 and the plurality of pixels P. Also, the plurality of reference gamma voltages may be used for the data driving chip array part 300 to convert digital data into an analog data voltage.

The display driving system 700 may be connected to the user connector 510 of the control board 500 through a signal transmission member 710. The display driving system 700 may generate the image signal from a video source and may supply the image signal to the timing controller 500. Here, the image signal may be supplied to the timing controller 500 by using the high speed serial interface manner (for example, a V-by-One interface manner).

Figure 5:
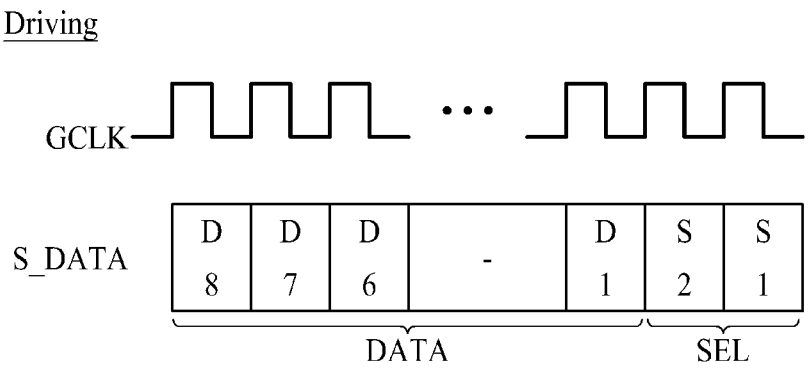
FIG. 5 is a diagram illustrating information about a serial data signal based on a first mode in a light emitting display apparatus according to an aspect of the present disclosure.

FIG. 5 is a diagram illustrating information about a serial data signal based on the first mode in a light emitting display apparatus according to an aspect of the present disclosure.

Referring to FIG. 5, the pixel driving chip 120 based on the first mode may receive the serial data signal S_DATA including digital data information and digital cell information to drive each of the plurality of pixels P in real time. For example, the serial data signal S_DATA based on the first mode may include the data information consisting of 8 bits and the cell information consisting of 2 bits. Here, a minimum number of bits for adding the cell information in each of subfields of a unit frame may be added to the serial data signal S_DATA based on the first mode. Also, the decoder D may generate the data signal DATA, based on the data information consisting of 8 bits and may supply the data signal DATA to the digital-to-analog converter DAC. Also, the decoder D may generate the input cell signal SEL', based on the cell information consisting of 2 bits and may supply the input cell signal SEL' to the cell signal controller SC. Therefore, the pixel driving chip 120 based on the first mode may receive the serial data signal S_DATA consisting of 10 bits in each subfield of the unit frame.

Figure 6:
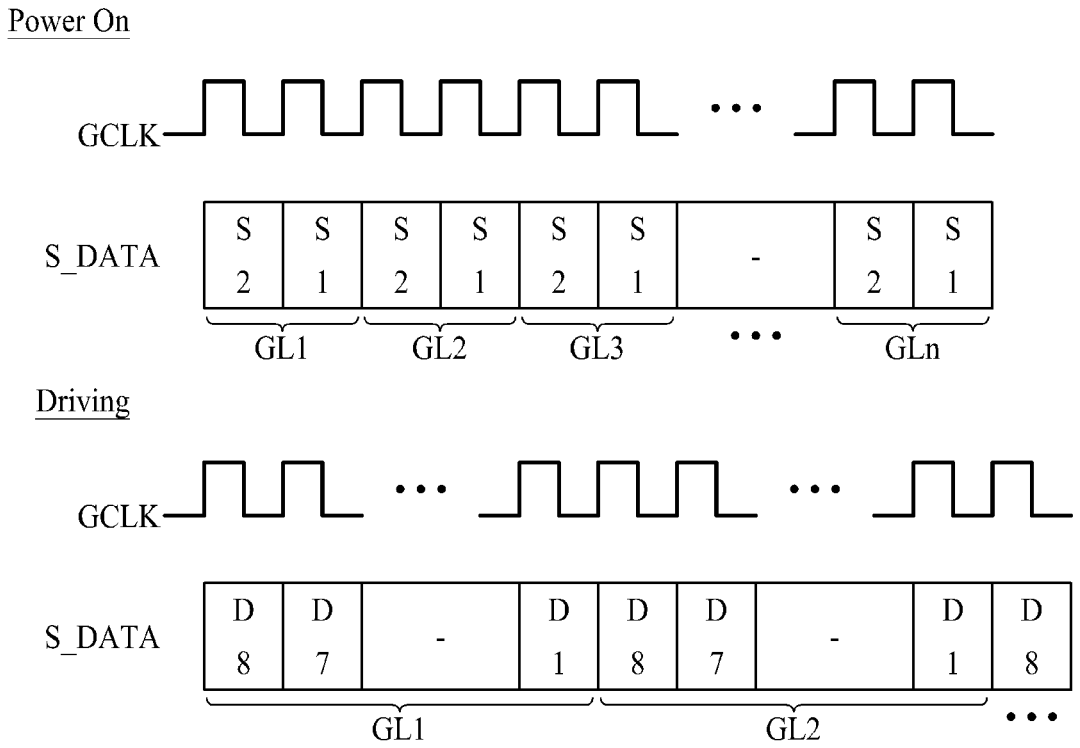
FIG. 6 is a diagram illustrating information about a serial data signal based on a second mode in a light emitting display apparatus according to an aspect of the present disclosure.

FIG. 6 is a diagram illustrating information about a serial data signal based on the second mode in a light emitting display apparatus according to an aspect of the present disclosure.

Referring to FIG. 6, the pixel driving chip 120 based on the second mode may previously receive the serial data signal S_DATA including only the cell information before each of the plurality of pixels P is driven (Power On) and may receive the serial data signal S_DATA including only the data information while driving each of the plurality of pixels P (Driving), thereby driving each of the plurality of pixels P. For example, the pixel driving chip 120 of each of the plurality of pixels P may receive the serial data signal S_DATA including the cell information consisting of 2 bits before each of the plurality of pixels P is driven (Power On), based on the reference clock signal GCLK input through first $n^{th}$ clock lines CL1 to CLn. Also, the pixel driving chip 120 of each of the plurality of pixels P may receive the serial data signal S_DATA including only the data information consisting of 8 bits while driving each of the plurality of pixels P (Driving), based on the reference clock signal GCLK. Therefore, since it is not required to add a bit for adding the cell information in each subfield of the unit frame, the pixel driving chip 120 based on the second mode may reduce a bandwidth of the serial data signal S_DATA. Accordingly, the pixel driving chip 120 based on the second mode may previously receive the serial data signal S_DATA including only the cell information, thereby more reducing a bandwidth than the first mode.

Figure 7:
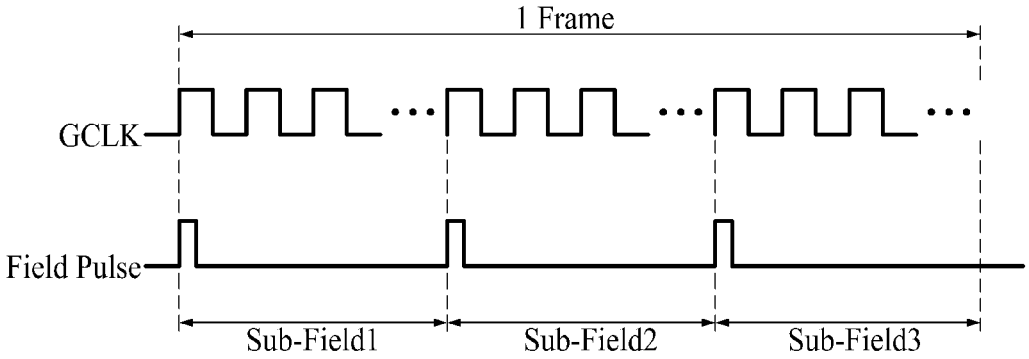
FIG. 7 is a waveform diagram showing a field pulse signal in a light emitting display apparatus according to an aspect of the present disclosure.

FIG. 7 is a waveform diagram showing a field pulse signal in a light emitting display apparatus according to an aspect of the present disclosure.

Referring to FIG. 7, the decoder D of the pixel driving chip 120 may generate the field pulse signal Field Pulse from the reference clock signal GCLK and may supply the field pulse signal Field Pulse to the cell signal controller SC, and the cell signal controller SC may output the cell signal SEL changed in a predetermined order, based on the field pulse signal Field Pulse. For example, when a unit frame 1Frame includes three subfields Sub-Field1 to Sub-Field3, the field pulse signal Field Pulse may have three pulses per unit frame, and thus, may be divided into first to third subfields Sub-Field1 to Sub-Field3. For example, the decoder D may count the reference clock signal GCLK to generate the field pulse signal Field Pulse which is used to divide the first to third subfields Sub-Field1 to Sub-Field3 of the unit frame 1Frame. Also, the unit frame 1Frame may be determined based on a synchronization signal V_SYNC. Therefore, the cell signal controller SC may generate different cell signals respectively corresponding to the subfields of the unit frame, based on the field pulse signal Field Pulse and the input cell signal SEL' and may supply a corresponding cell signal to the multiplexer MUX in each subfield. Therefore, the cell signal controller SC may output the cell signal SEL in each of the first to third subfields, based on the field pulse signal Field Pulse, and thus, the multiplexer MUX may match pre-stored cell information with data information received in real time and may sequentially select corresponding output terminals from among the plurality of output terminals OUT.

Figure 8A:
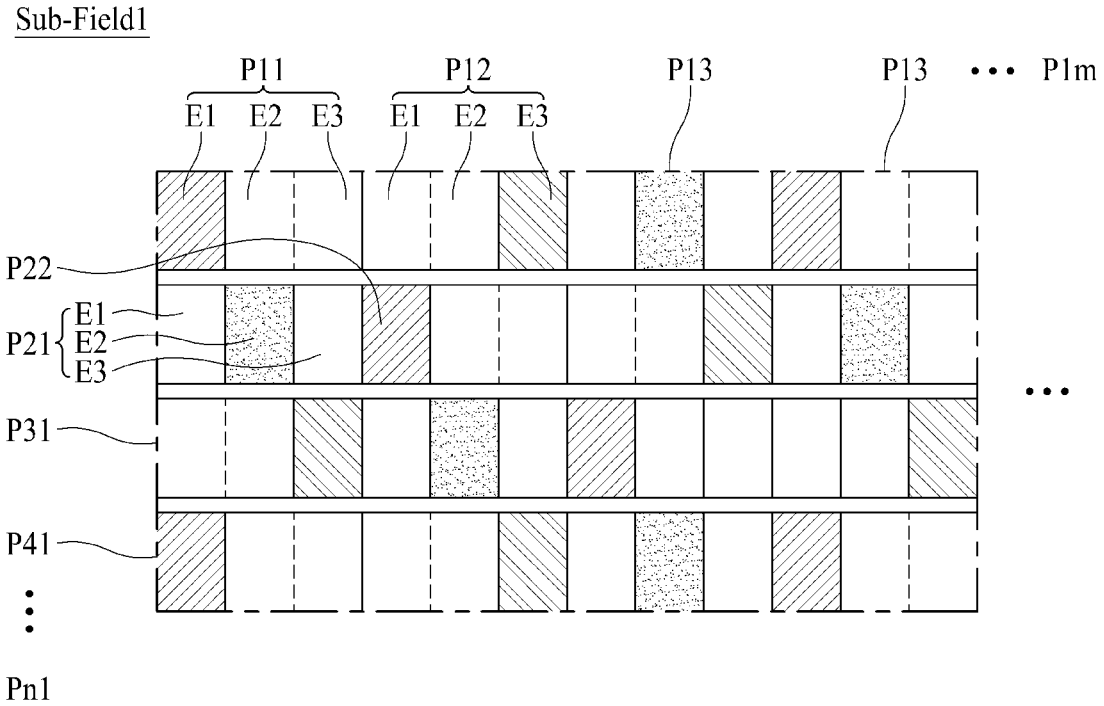
FIGS. 8A to 8C are diagrams showing subfield-based outputs of a plurality of pixels in a light emitting display apparatus according to an aspect of the present disclosure.
Figure 8B:
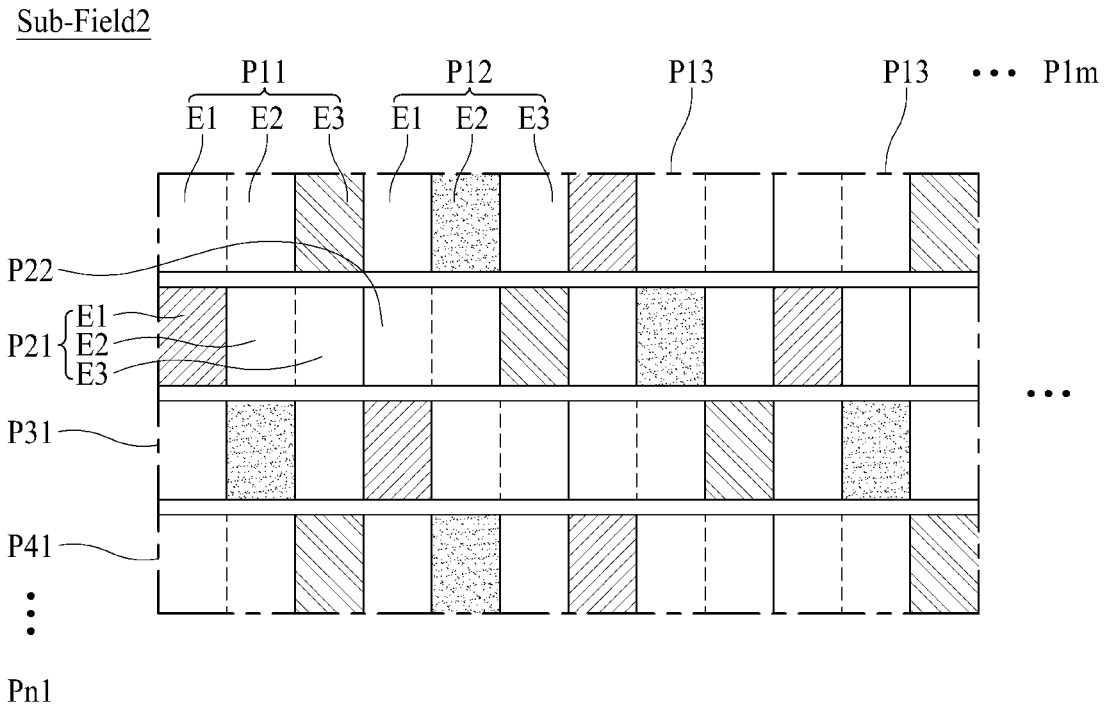
Figure 8C:
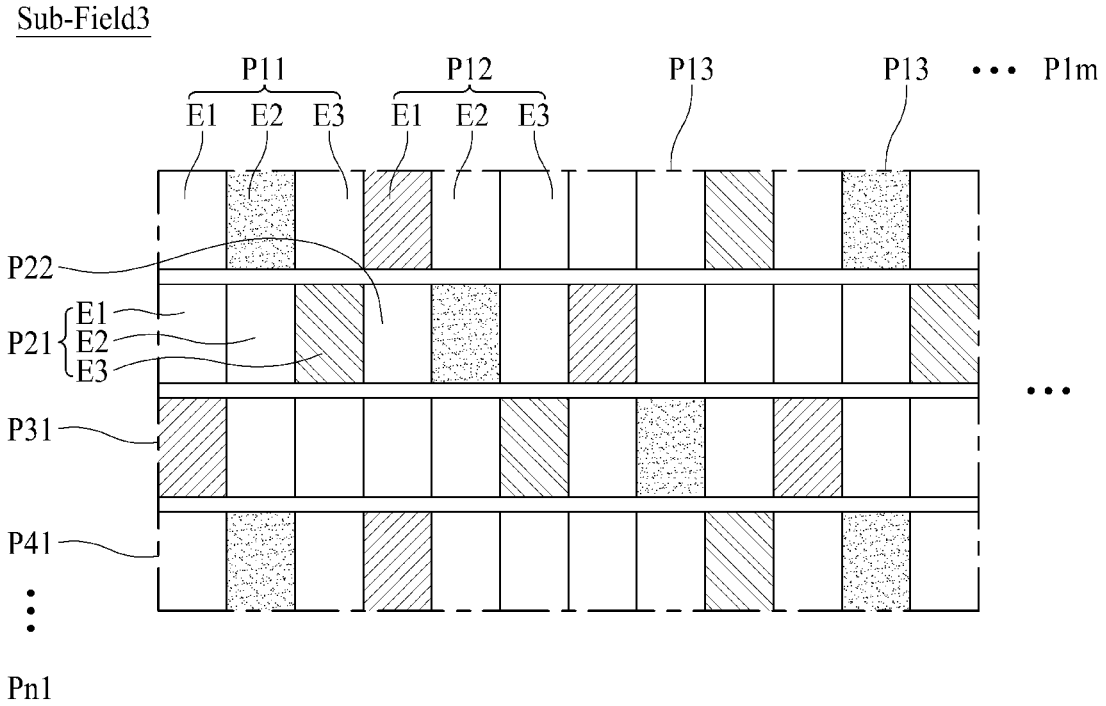

FIGS. 8A to 8C are diagrams showing subfield-based outputs of a plurality of pixels in a light emitting display apparatus according to an aspect of the present disclosure.

Referring to FIGS. 8A to 8C, the plurality of light emitting devices E may respectively and sequentially receive the driving current Id through the plurality of output terminals OUT to emit light of different colors during a unit frame. According to an aspect, the plurality of light emitting devices E may include the first to third light emitting devices E1 to E3 respectively connected to the first to third output terminals O1 to O3 of the pixel driving chip 120. Here, each of the first to third light emitting devices E1 to E3 may emit one of red light, green light, and blue light. For example, the first light emitting device E1 may receive the driving current Id through the first output terminal O1 to emit red light during a first subfield Sub-Field1 of the unit frame. Also, the third light emitting device E3 may receive the driving current Id through the third output terminal O2 to emit blue light during a second subfield Sub-Field2 of the unit frame. Also, the second light emitting device E2 may receive the driving current Id through the second output terminal O3 to emit green light during a third subfield Sub-Field3 of the unit frame. As described above, the light emitting display apparatus may alternately supply the driving current Id to the plurality of light emitting devices E in each of the subfields of the unit frame, thereby preventing the occurrence of the color breaking phenomenon. Here, the color breaking phenomenon may be referred to as a rainbow phenomenon and may denote a phenomenon where colors displayed by the display panel 100 are mixed to instantaneously cause noise such as rainbow. That is, the color breaking phenomenon causes adverse visibility to decrease a visibility of a viewer who is watching an image. Accordingly, the light emitting display apparatus according to the present disclosure prevents the occurrence of the color breaking phenomenon, thereby enhancing a sharp visibility of the light emitting display apparatus.

According to an aspect, the pixel driving chip 120 of each of adjacent pixels P of the plurality of pixels P may output the driving current Id through different output terminals. In detail, each of the plurality of pixels P may include the first to third light emitting devices E1 to E3 which are arranged in parallel in the first direction X. That is, a third light emitting device E3 of a 1-$1^{th}$ pixel P11 and a first light emitting device E1 of a 1-$2^{th}$ pixel P12 may be disposed adjacent to each other. For example, when a pixel driving chip 120 of the 1-$1^{th}$ pixel P11 outputs the driving current Id through a third output terminal O3 thereof, a pixel driving chip 120 of the 1-$2^{th}$ pixel P12 may output the driving current Id through a second output terminal O2 thereof. Also, when the pixel driving chip 120 of the 1-$2^{th}$ pixel P12 outputs the driving current Id through a first output terminal O1 thereof, the pixel driving chip 120 of the 1-$1^{th}$ pixel P11 may output the driving current Id through a second output terminal O2 thereof. Accordingly, the third light emitting device E3 of the 1-$1^{th}$ pixel P11 and the first light emitting device E1 of the 1-$2^{th}$ pixel P12 which are adjacent to each other may not simultaneously emit light, thereby preventing the occurrence of the color breaking phenomenon.

First to third light emitting devices E1 to E3 of the 1-$1^{th}$ pixel P11 may be respectively disposed adjacent to first to third light emitting devices E1 to E3 of a 2-$1^{th}$ pixel P21. For example, when the pixel driving chip 120 of the 1-$1^{th}$ pixel P11 outputs the driving current Id through a first output terminal O1 thereof, a pixel driving chip 120 of the 2-$1^{th}$ pixel P21 may output the driving current Id through the second output terminal O2 thereof. Also, when the pixel driving chip 120 of the 1-$1^{th}$ pixel P11 outputs the driving current Id through a second output terminal O2 thereof, the pixel driving chip 120 of the 2-$1^{th}$ pixel P21 may output the driving current Id through a third output terminal O3 thereof. Also, when the pixel driving chip 120 of the 1-$1^{th}$ pixel P11 outputs the driving current Id through the third output terminal O3 thereof, the pixel driving chip 120 of the 2-$1^{th}$ pixel P21 may output the driving current Id through a first output terminal O1 thereof. Accordingly, each of the first to third light emitting devices E1 to E3 of the 1-$1^{th}$ pixel P11 and a corresponding light emitting device of the first to third light emitting devices E1 to E3 of the 2-$1^{th}$ pixel P21, which are adjacent to each other, may not simultaneously emit light, thereby preventing the occurrence of the color breaking phenomenon.

According to an aspect, each of adjacent pixels P of the plurality of pixels P may select one output terminal OUT from among the plurality of output terminals OUT in different orders during a unit frame and may output the driving current Id through the selected one output terminal OUT. In detail, the plurality of pixels P may be arranged in the first direction X and the second direction Y. That is, the 1-1$^{th}$ pixel P11 and the 1-2$^{th}$ pixel P12 may be arranged in parallel in the first direction X, and the 1-1$^{th}$ pixel P11 and the 2-1$^{th}$ pixel P21 may be arranged in parallel in the second direction Y. For example, when the 1-1$^{th}$ pixel P11 outputs the driving current Id in the order of the first output terminal O1, the third output terminal O3, and the second output terminal O2 during the unit frame, the 1-2$^{th}$ pixel P12 may output the driving current Id in the order of the third output terminal O3, the second output terminal O2, and the first output terminal O1 during the unit frame, and the 2-1$^{th}$ pixel P21 may output the driving current Id in the order of the second output terminal O2, the first output terminal O1, and the third output terminal O3 during the unit frame. In this manner, when one pixel of the plurality of pixels P selects one output terminal OUT from among the plurality of output terminals OUT in the same order as the 1-1$^{th}$ pixel P11, the one pixel may not be adjacent to the 1-1$^{th}$ pixel P11. Accordingly, since each of adjacent pixels P of the plurality of pixels P selects one output terminal OUT from among the plurality of output terminals OUT in different orders during a unit frame and outputs the driving current Id through the selected one output terminal OUT, light emitting devices E adjacent to each other may be prevented from simultaneously emitting light, thereby preventing the occurrence of the color breaking phenomenon.

According to an aspect, when a light emitting device E of an adjacent pixel P emits light, the pixel driving chip 120 of each of the plurality of pixels P may supply the driving current Id to a light emitting device E spaced apart from the light emitting device E of the adjacent pixel P. For example, when a first light emitting device E1 of the 1-2$^{th}$ pixel P12 emits light, a pixel driving chip 120 of the 1-1$^{th}$ pixel P11 may supply the driving current Id to a second light emitting device E2 of the 1-1$^{th}$ pixel P11 spaced apart from the first light emitting device E1 of the 1-2$^{th}$ pixel P12. Therefore, the pixel driving chip 120 of each of the plurality of pixels P may prevent light emitting devices E adjacent to each other from simultaneously emitting light, thereby preventing the occurrence of the color breaking phenomenon.

Figure 9:
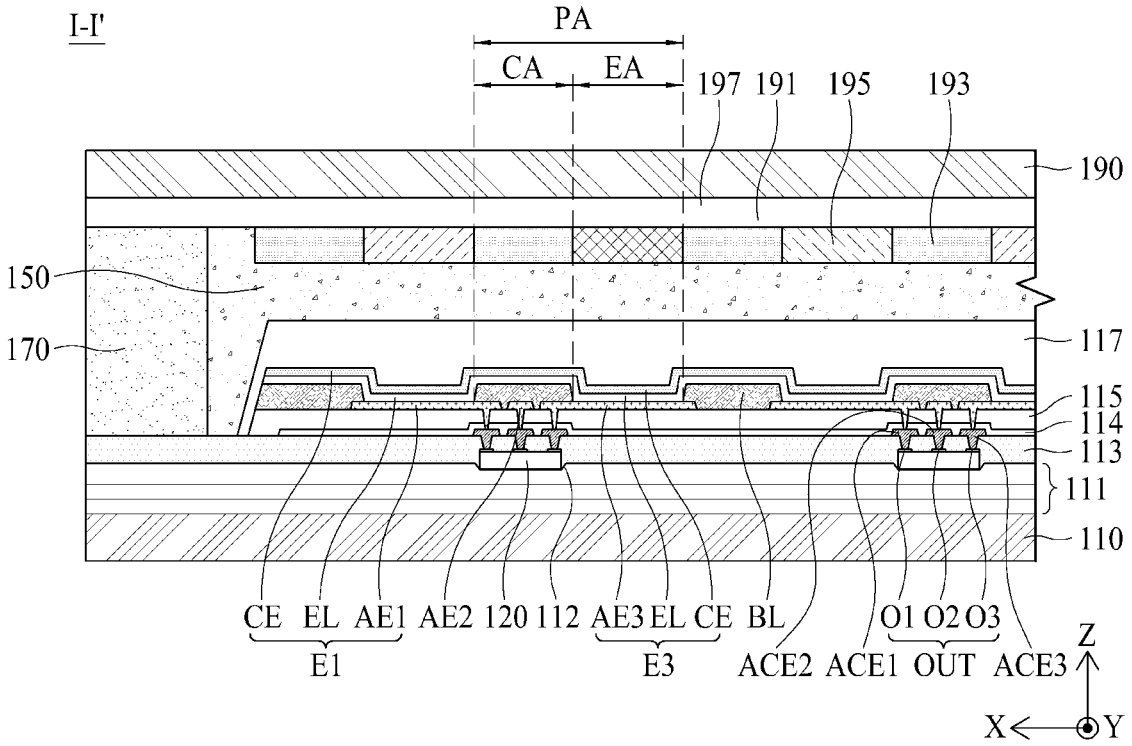
FIG. 9 is a cross-sectional view taken along line I-I' illustrated in FIG. 1.

FIG. 9 is a cross-sectional view taken along line I-I' illustrated in FIG. 1 and is a cross-sectional view illustrating adjacent pixels provided in the display panel illustrated in FIG. 1.

Referring to FIG. 9, a light emitting display apparatus according to an aspect of the present disclosure may include a substrate 110, a buffer layer 111, a pixel driving chip 120, a first planarization layer 113, an insulation layer 114, a second planarization layer 115, an encapsulation layer 117, and a plurality of light emitting devices E.

The substrate 110, a base substrate, may be formed of an insulating material such as glass, quartz, ceramic, or plastic. The substrate 110 may include a plurality of pixel areas PA each including an emitting area EA and a circuit area CA.

The buffer layer 111 may be provided on the substrate 110. The buffer layer 111 may prevent water from penetrating into the plurality of light emitting devices E through the substrate 110. According to an aspect, the buffer layer 111 may include at least one inorganic layer including an inorganic material. For example, the buffer layer 111 may be a multilayer where one or more inorganic layers of silicon oxide ($SiO_x$), silicon nitride ($SiN_x$), silicon oxynitride (SiON), titanium oxide ($TiO_x$), and aluminum oxide ($AlO_x$) are alternately stacked.

Each of the plurality of pixel driving chips 120 may be mounted on the buffer layer 111 in the circuit area CA of each of the plurality of pixel areas PA through a chip mounting process. The plurality of pixel driving chips 120 may each have a size of 1 μm to 100 μm, but are not limited thereto. In other aspects, the plurality of pixel driving chips 120 may each have a size which is smaller than that of the emitting area EA other than an area occupied by the circuit area CA among the plurality of pixel areas PA. Each of the plurality of pixel driving chips 120, as described above, may include the pixel driving circuit PC, the driving current generator VIC, and the multiplexer MUX, and thus, its repetitive description will be omitted.

The plurality of pixel driving chips 120 may be attached on the buffer layer 111 by an adhesive layer. Here, the adhesive layer may be provided on a rear surface (or a back surface) of each of the plurality of pixel driving chips 120. For example, in the chip mounting process, a vacuum adsorption nozzle may vacuum-adsorb the plurality of pixel driving chips 120 each including the rear surface (or the back surface) coated with the adhesive layer, and thus, the plurality of pixel driving chips 120 may be mounted on (or transmitted onto) the buffer layer 111 in a corresponding pixel area PA.

Optionally, the plurality of pixel driving chips 120 may be respectively mounted on a plurality of concave portions 112 respectively provided in the circuit areas CA of the plurality of pixel areas PA.

Each of the plurality concave portions 112 may be recessed from a front surface of the buffer layer 111 disposed in a corresponding circuit area CA. For example, each of the plurality of concave portions 112 may have a groove shape or a cup shape which has a certain depth from the front surface of the buffer layer 111. Each of the plurality of concave portions 112 may individually accommodate and fix a corresponding pixel driving chip of the plurality of pixel driving chips 120, thereby minimizing an increase in thickness of the light emitting display apparatus caused by a thickness (or a height) of each of the plurality of pixel driving chips 120. Each of the plurality of concave portions 112 may be concavely formed to have a shape corresponding to the plurality of pixel driving chips 120 and to have an inclined surface inclined at a certain angle, and thus, misalignment between the circuit areas CA and the pixel driving chips 120 is minimized in a mount process of mounting the plurality of pixel driving chips 120 on the buffer layer 111.

The plurality of pixel driving chips 120 according to an aspect may be respectively attached on floors of the plurality of concave portions 112 by the adhesive layer coated on each of the plurality of concave portions 112. According to another aspect, the plurality of pixel driving chips 120 may be respectively attached on the floors of the plurality of concave portions 112 by the adhesive layer coated on a whole surface of the buffer layer 111 including the plurality of concave portions 112.

The first planarization layer 113 may be disposed on a front surface of the substrate 110 and may cover the plurality of pixel driving chips 120. That is, the first planarization layer 113 may cover the buffer layer 111 and the plurality of pixel driving chips 120 disposed on the substrate 110, and thus, may provide a flat surface on the buffer layer 111 and the plurality of pixel driving chips 120 and may fix the plurality of pixel driving chips 120. For example, the first planarization layer 113 may be formed of acryl resin, epoxy resin, phenolic resin, polyamide resin, polyimide resin, and/or the like.

The insulation layer 114 may be disposed on the substrate 110 to cover a plurality of anode connection electrodes (for example, first to third anode connection electrodes) ACE1 to ACE3. For example, the insulation layer 114 may be $SiO_x$, $SiN_x$, SiON, or a multilayer thereof.

The first to third anode connection electrodes ACE1 to ACE3 may respectively connect first to third anode electrodes AE1 to AE3 to first to third output terminals O1 to O3 of a pixel driving chip 120. The first to third anode connection electrodes ACE1 to ACE3 may be provided on the first planarization layer 113 and may be covered by the insulation layer 114.

Each of the first to third anode connection electrodes ACE1 to ACE3 may be formed of molybdenum (Mo), aluminum (Al), chrome (Cr), gold (Au), titanium (Ti), nickel (Ni), neodymium (Nd), copper (Cu), or an alloy thereof and may be formed of a single layer including at least one of the metals or the alloy or a multilayer which includes two or more layers and includes at least one of the metals or the alloy.

The second planarization layer 115 may be disposed on the substrate 110 to cover the insulation layer 114. That is, the second planarization layer 115 may provide a flat surface on the insulation layer 114. For example, the second planarization layer 115 may be formed of acryl resin, epoxy resin, phenolic resin, polyamide resin, polyimide resin, and/or the like, but is not limited thereto.

The encapsulation layer 117 may be disposed on the substrate 110 to cover the plurality of light emitting devices E. According to an aspect, the encapsulation layer 117 may prevent oxygen or water from penetrating into a light emitting layer EL of each of the plurality of light emitting devices E. According to an aspect, the encapsulation layer 117 may include one inorganic material of silicon oxide ($SiO_x$), silicon nitride ($SiN_x$), silicon oxynitride (SiON), titanium oxide ($TiO_x$), and aluminum oxide ($AlO_x$).

Optionally, the encapsulation layer 117 may further include at least one organic layer. The organic layer may be formed to have a sufficient thickness, for preventing particles from penetrating into a light emitting device layer via the encapsulation layer 117. According to an aspect, the organic layer may be formed of one organic material of acryl resin, epoxy resin, phenolic resin, polyamide resin, polyimide resin, benzocyclobutene resin, and fluorine resin.

The plurality of light emitting devices E may each include a plurality of anode electrodes (for example, the first to third anode electrodes) AE1 to AE3, the light emitting layer EL, a cathode electrode CE and a bank layer BL.

Each of the plurality of anode electrodes AE1 to AE3 may be individually patterned in each of the pixel areas PA. Each of the plurality of anode electrodes AE1 to AE3 may be electrically connected to an output terminal OUT of a corresponding pixel driving chip 120 through an anode contact hole provided in the second planarization layer 115 in a corresponding pixel area PA and may be supplied with a data current through the output terminal OUT of the corresponding pixel driving chip 120. According to an aspect, the plurality of anode electrodes AE1 to AE3 may each include a metal material which is high in reflectance. For example, each of the plurality of anode electrodes AE1 to AE3 may be formed in a multilayer structure such as a stacked structure (Ti/Al/Ti) including aluminum (Al) and titanium (Ti), a stacked structure (ITO/Al/ITO) including aluminum (Al) and indium tin oxide (ITO), an APC (Al/Pd/Cu) alloy of Al, palladium (Pd), and Cu, or a stacked structure (ITO/APC/ITO) including an APC alloy and ITO, or may include a single-layer structure including one material or an alloy of two or more materials selected from among silver (Ag), aluminum (Al), molybdenum (Mo), gold (Au), magnesium (Mg), calcium (Ca), and barium (Ba).

The light emitting layer EL may be disposed in an emitting area EA on the plurality of anode electrodes AE1 to AE3.

The light emitting layer EL according to an aspect may include two or more sub light emitting layers for emitting white light. For example, the light emitting layer EL may include a first sub light emitting layer and a second sub light emitting layer for emitting white light based on a combination of first light and second light. Here, the first sub light emitting layer may emit the first light and may include one of a blue light emitting layer, a green light emitting layer, a red light emitting layer, a yellow light emitting layer, and a yellow-green light emitting layer. The second sub light emitting layer may include a light emitting layer, which emits light having a complementary color relationship with the first light, of a blue light emitting layer, a green light emitting layer, a red light emitting layer, a yellow light emitting layer, and a yellow-green light emitting layer. Since the light emitting layer EL emits white light, the light emitting layer EL may be provided on the substrate 110 to cover the plurality of anode electrodes AE1 to AE3 and the bank layer BL without being individually patterned in each pixel area PA.

Additionally, the light emitting layer EL may additionally include one or more function layers for enhancing the emission efficiency and/or lifetime of the light emitting layer EL.

The cathode electrode CE may be disposed to cover the light emitting layer EL. In order for light emitted from the light emitting layer EL to be irradiated onto the opposite substrate 190, the cathode electrode CE according to an aspect may be formed of indium tin oxide (ITO) or indium zinc oxide (IZO), which is a transparent conductive material such as transparent conductive oxide (TCO).

The bank layer BL may define the emitting area EA in each of the plurality of pixel areas PA and may be referred to as a pixel defining layer (or an isolation layer). The bank layer BL may be provided on the second planarization layer 115 and in an edge of each of the plurality of anode electrodes AE and may overlap the circuit area CA of the pixel area PA to define the emitting area EA in each pixel area PA. For example, the bank layer BL may be formed of one organic material of acryl resin, epoxy resin, phenolic resin, polyamide resin, polyimide resin, benzocyclobutene resin, and fluorine resin. As another example, the bank layer BL may be formed of a photosensitive material including a black pigment. In this case, the bank layer BL may act as a light blocking pattern.

The opposite substrate 190 may be defined as a color filter array substrate. The opposite substrate 190 according to an aspect may include a barrier layer 191, a black matrix 193, and a color filter layer 195.

The barrier layer 191 may be provided one whole surface of the opposite substrate 190 facing the substrate 110 and may prevent penetration of external water or moisture. The barrier layer 191 according to an aspect may include at least one inorganic layer including an inorganic material. For example, the barrier layer 191 may be formed of a multilayer where one or more inorganic layers of silicon oxide ($SiO_x$), silicon nitride ($SiN_x$), silicon oxynitride (SiON), titanium oxide ($TiO_x$), and aluminum oxide ($AlO_x$) are alternately stacked.

The black matrix 193 may be disposed on the barrier layer 191 to overlap the bank layer BL provided on the substrate 110 and may define a plurality of transmissive parts respectively overlapping the emitting areas EA of the plurality of pixel areas PA. The black matrix 193 may be formed of a resin material or an opaque metal material such as chrome Cr or CrOx, or may be formed of a light absorbing material.

The color filter layer 195 may be disposed in each of the plurality of transmissive parts provided by the black matrix 193. The color filter layer 195 may include one of a red color filter, a green color filter, and a blue color filter. The red color filter, the green color filter, and the blue color filter may be repeatedly disposed in a first direction X.

Optionally, the color filter layer 195 may include a quantum dot which has a size enabling light of a predetermined color to be emitted and re-emits light according to light incident from the light emitting layer EL. Here, the quantum dot may be selected from among CdS, CdSe, CdTe, ZnS, ZnSe, GaAs, GaP, GaAs—P, Ga—Sb, InAs, InP, InSb, AlAs, AlP, AlSb, and the like. For example, the red color filter may include a quantum dot (for example, CdSe or InP) emitting red light, the green color filter may include a quantum dot (for example, CdZnSeS) emitting green light, and the blue color filter may include a quantum dot (for example, ZnSe) emitting blue light. As described above, when the color filter layer 195 includes a quantum point, a color reproduction rate increases.

The opposite substrate 190 may be opposite-bonded to the substrate 110 by the transparent adhesive layer 150. Here, the transparent adhesive layer 150 may be referred to as a filler. The transparent adhesive layer 150 according to an aspect may be formed of a material capable of being filling between the substrate 110 and the opposite substrate 190, and for example, may be formed of a transparent epoxy material capable of transmitting light, but the present disclosure is not limited thereto. The transparent adhesive layer 150 may be formed on the substrate 110 by a process such as an inkjet process, a slit coating process, or a screen printing process, but is not limited thereto. In other aspects, the transparent adhesive layer 150 may be provided on the opposite substrate 190.

Additionally, the light emitting display apparatus according to an aspect of the present disclosure may further include a dam pattern 170 which surrounds an outer portion of the transparent adhesive layer 150.

The dam pattern 170 may be provided in an edge of the opposite substrate 190 in a closed loop form. The dam pattern 170 according to an aspect may be provided in an edge of the barrier layer 191 provided on the opposite substrate 190 to have a certain height. The dam pattern 170 may block the spread or overflow of the transparent adhesive layer 150 and may bond the substrate 110 to the opposite substrate 190. The dam pattern 170 according to an aspect may be formed of a high-viscosity resin (for example, an epoxy material) capable of being cured by light such as ultraviolet (UV). Furthermore, the dam pattern 170 may be formed of an epoxy material including a getter material capable of adsorbing water and/or oxygen, but is not limited thereto. The dam pattern 170 may block penetration of external water and/or oxygen into a gap between the substrate 110 and the opposite substrate 190 bonded to each other to protect the light emitting layer EL from the external water and/or oxygen, thereby increasing the reliability of the light emitting layer EL and preventing the lifetime of the light emitting layer EL from being reduced by the water and/or oxygen.

Figure 10:
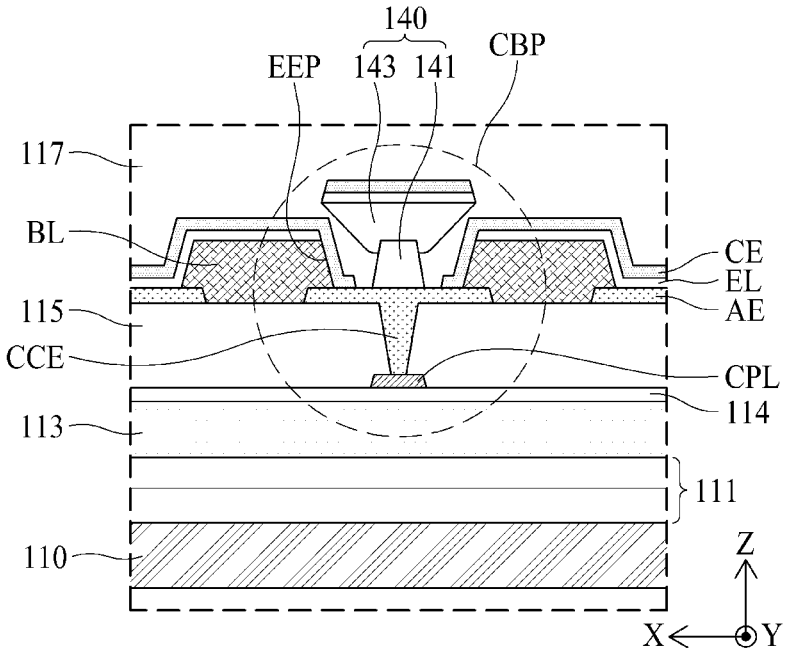
FIG. 10 is a diagram illustrating a connection structure between a cathode electrode and a cathode power supply line in a light emitting display apparatus according to an aspect of the present disclosure.

FIG. 10 is a diagram illustrating a connection structure between a cathode electrode and a cathode power supply line in a light emitting display apparatus according to an aspect of the present disclosure.

Referring to FIG. 10, a substrate 110 according to an aspect of the present disclosure may further include a plurality of cathode power lines which are disposed in parallel on an insulation layer 114 with at least one data line DL therebetween to pass through a display area DA.

The plurality of cathode power lines may receive a cathode voltage (for example, a ground voltage) from the power management circuit 600 through the pad part PP. The plurality of cathode power lines may be electrically connected to a cathode electrode CE in the display area DA. According to an aspect, a bank layer BL may include a plurality of cathode sub-contact parts CBP which are electrically connected to a plurality of cathode power lines CPL and a cathode electrode CE.

The plurality of cathode sub-contact part CBP may include a plurality of cathode connection electrodes CCE and a plurality of electrode exposure parts EEP.

The plurality of cathode connection electrodes CCE may be provided in an island shape on a second planarization layer 115 overlapping the bank layer BL and may be formed of the same material along with the anode electrode AE. An edge, other than a center, of each of the cathode connection electrodes CCE may be surrounded by the bank layer BL and may be spaced apart from and electrically disconnected from an adjacent anode electrode AE. Each of the cathode connection electrodes may be electrically connected to a corresponding cathode power line CPL through a cathode contact hole provided in the second planarization layer 115. In this case, one cathode power line CPL may be electrically connected to at least one cathode connection electrode CCE through at least one cathode contact hole.

The plurality of electrode exposure parts EEP may be disposed on the bank layer BL overlapping the plurality of cathode connection electrodes CCE and may respectively expose the plurality of cathode connection electrodes CCE. Thus, the cathode electrode CE may be electrically connected to each of the plurality of cathode connection electrodes CCE respectively exposed through the plurality of electrode exposure parts EEP and may be electrically connected to each of the plurality of cathode power lines CPL through the plurality of cathode connection electrodes CCE, and thus, may have a relatively low resistance. In particular, the cathode electrode CE may receive the cathode voltage from each of the plurality of cathode power lines CPL through the plurality of cathode connection electrodes CCE, thereby preventing non-uniform luminance caused by the voltage drop (IR drop) of the cathode voltage supplied to the cathode electrode CE.

According to an aspect, the substrate 110 may further include a partition wall part 140.

The partition wall part 140 may include a partition wall supporting part 141 disposed in each of the plurality of cathode connection electrodes CCE and a partition wall 143 disposed on the partition wall supporting part 141.

The partition wall supporting part 141 may be provided in the center of each of the plurality of cathode connection electrodes CCE to have a tapered structure having a trapezoidal cross-sectional surface.

The partition wall 143 may be provided on the partition wall supporting part 141 to have a reverse-tapered structure where a width of a lower surface is narrower than that of an upper surface, and may hide a corresponding electrode exposure part EEP. For example, the partition wall 143 may include a lower surface having a first width supported by the partition wall supporting part 141, an upper surface having a second width which is greater than the first width and is greater than or equal to a width of the electrode exposure part EEP, and an inclined surface which is disposed between the lower surface and the upper surface to hide the electrode exposure part EEP. The upper surface of the partition wall 143 may be provided to cover the electrode exposure part EEP and to one-dimensionally have a size which is greater than or equal to that of the electrode exposure part EEP, and thus, a light emitting material may be prevented from penetrating into the cathode connection electrode CCE exposed at the electrode exposure part EEP in a process of depositing the light emitting layer EL, whereby a cathode electrode material may be electrically connected to the cathode connection electrode CCE exposed at the electrode exposure part EEP in the process of depositing the light emitting layer EL. A penetration space (or a void) may be provided between the inclined surface of the partition wall 143 and the cathode connection electrode CCE exposed at the electrode exposure part EEP, and the edge of the cathode electrode CE may be electrically connected to the cathode connection electrode CCE exposed at the electrode exposure part EEP through the penetration space.

Figure 11:
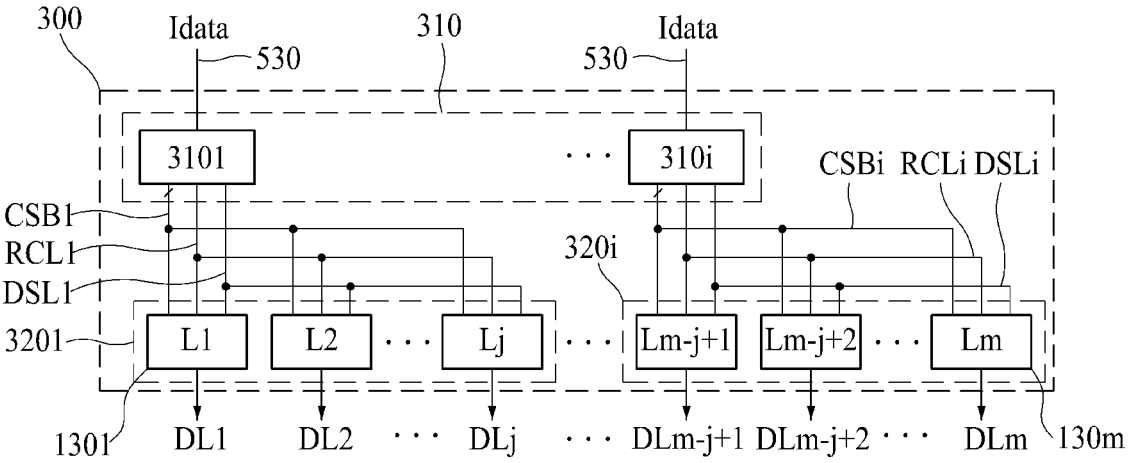
FIG. 11 is a diagram illustrating a data driving chip array part illustrated in FIG. 2.

FIG. 11 is a diagram illustrating the data driving chip array part 300 illustrated in FIG. 2.

Referring to FIG. 11 in conjunction with FIGS. 1 and 2, the data driving chip array part 300 may include a data reception chip array 310 and first to $m^{th}$ data latch chips L1 to Lm. Here, each of the first to $m^{th}$ data latch chips L1 to Lm may be a minimum-unit microchip or one chipset and may be a semiconductor packaging device which includes an integrated circuit (IC) including a plurality of transistors and has a fine size.

The data reception chip array 310 may receive an input digital data signal Idata and may output pixel data for at least one horizontal line. The data reception chip array 310 may receive a digital data signal corresponding to a differential signal transmitted from the timing controller 500 according to a high-speed serial interface manner, for example, an embedded point to point interface (EPI) manner, a low-voltage differential signaling (LVDS) interface manner, or a Mini LVDS interface manner, may generate at least one horizontal line unit of pixel data on the basis of the received digital data signal, and may generate a reference clock and a data start signal from the differential signal.

According to an aspect, the data reception chip array 310 may include first to $i^{th}$ data reception chips 3101 to 310*i* (where i is a natural number greater than or equal to two). Here, each of the first to $i^{th}$ data reception chips 3101 to 310*i* may be a minimum-unit microchip or one chipset and may be a semiconductor packaging device which includes an IC including a plurality of transistors and has a fine size.

Each of the first to $i^{th}$ data reception chips 3101 to 310*i* may individually receive digital data signals to be supplied to j pixels (where j is a natural number of 2 or greater) among differential signals transmitted from the timing controller 500 through a single interface cable 530, individually generate pixel data to be supplied to the j pixels on the basis of the received digital data signals, and individually generate a reference clock and a data start signal from the differential signals. For example, when the interface cable 530 has first to $i^{th}$ pairs, the first data reception chip 3101 may individually receive digital data signals corresponding to first to $i^{th}$ pixels from the differential signals transmitted from the timing controller 500 through the first pair of the interface cable 530, individually generate pixel data corresponding to the first to $j^{th}$ pixels on the basis of the received digital data signals, and individually generate a reference clock and a data start signal from the differential signals. Also, the $i^{th}$ data reception chip 310*i* may individually receive digital data signals corresponding to $m-j+1^{th}$ to $m^{th}$ pixels from the differential signals transmitted from the timing controller 500 through the $i^{th}$ pair of the interface cable 530, individually generate pixel data corresponding to the $m-j+1^{th}$ to $m^{th}$ pixels on the basis of the received digital data signals, and individually generate a reference clock and a data start signal from the differential signals.

The first to $i^{th}$ data reception chips 3101 to 310*i* may individually output pixel data through a serial data communication manner using first to $i^{th}$ common serial data buses CSB1 to CSBi each having a data bus corresponding to the number of bits of the pixel data, individually output the reference clock to first to $i^{th}$ common reference clock lines RCL1 to RCLi, and individually output the data start signal to first to $i^{th}$ data start signal lines DSL1 to DSLi. For example, the first data reception chip 3101 may transmit corresponding pixel data, a corresponding reference clock, and a corresponding data start signal through the first common serial data bus CSB1, the first common reference clock line RCL1, and the first data start signal line DSL1. Also, the $i^{th}$ data reception chip 310*i* may transmit corresponding pixel data, a corresponding reference clock, and a corresponding data start signal through the $i^{th}$ common serial data bus CSBi, the $i^{th}$ common reference clock line RCLi, and the $i^{th}$ data start signal line DSLi.

According to an aspect, the data reception chip array 310 may be configured with only one data reception chip. That is, the first to $i^{th}$ data reception chips 3101 to 310*i* may be integrated into a single integrated data reception chip.

Each of the first to $m^{th}$ data latch chips L1 to Lm may sample and latch (or hold) pixel data transmitted from the data reception chip array 310 according to the reference clock on the basis of the data start signal, and may output the received reference clock and the latched pixel data through a serial data communication manner.

The first to $m^{th}$ data latch chips L1 to Lm may be grouped into first to $i^{th}$ data latch groups 3201 to 320*i*, each of which consists of j data latch chips.

On a group basis, the data latch chips grouped into the first to $i^{th}$ data latch groups 3201 to 320*i* may be connected to the first to $i^{th}$ common serial data buses CSB1 to CSBi in common. For example, each of the first to $j^{th}$ data latch chips L1 to Lj grouped into the first data latch group 3201 may receive corresponding pixel data, a corresponding reference clock, and a corresponding start signal through the first common serial data bus CSB1, the first common reference clock line RCL1, and the first data start signal line DSL1. Also, each of $m-j+1^{th}$ to $m^{th}$ data latch chips Lm−j+1 to Lm grouped into the $i^{th}$ data latch group 320*i* may receive corresponding pixel data, a corresponding reference clock, and a corresponding data start signal through the $i^{th}$ common serial data bus CSBi, the $i^{th}$ common reference clock line RCLi, and the $i^{th}$ data start signal line DSLi.

When pixel data having a corresponding number of bits is sampled and latched, each of the first to $m^{th}$ data latch chips L1 to Lm may output the received reference clock and the latched pixel data through a serial data communication manner.

According to an aspect, each of the first to $m^{th}$ data latch chips L1 to Lm may include a latch circuit configured to sample and latch pixel data input through a corresponding common serial data bus CSB according to the reference clock in response to the data start signal, a counter circuit configured to count the reference clock and generate a data output signal, and a clock bypass circuit configured to bypass the received reference clock.

Additionally, one data reception chip, one data latch chip, and one digital-to-analog conversion chip for supplying data voltage to one data line may configure each of the data driving chip groups 1301 to 130*m*, which may be configured as a single data driving chip. In this case, the number of chips connected to each of the first to $m^{th}$ data lines DL1 to DLm may decrease by a factor of ⅓.

The data driving chip array part 300 may be mounted in the non-display area of the substrate to covert digital data input from the outside into a data voltage and supply the data voltage to the first to $m^{th}$ data lines DL1 to DLm. Accordingly, it is possible to omit a source printed circuit board and flexible circuit films provided in the display apparatus and thus to simplify the configuration of the display apparatus. Therefore, in the light emitting display apparatus according to the present disclosure, an area occupied by the data driving chip array part 300 in the non-display area of the substrate may be reduced, thereby minimizing an increase in bezel width of the display apparatus caused by mounting the data driving chip array part 300 on the substrate.

Figure 12:
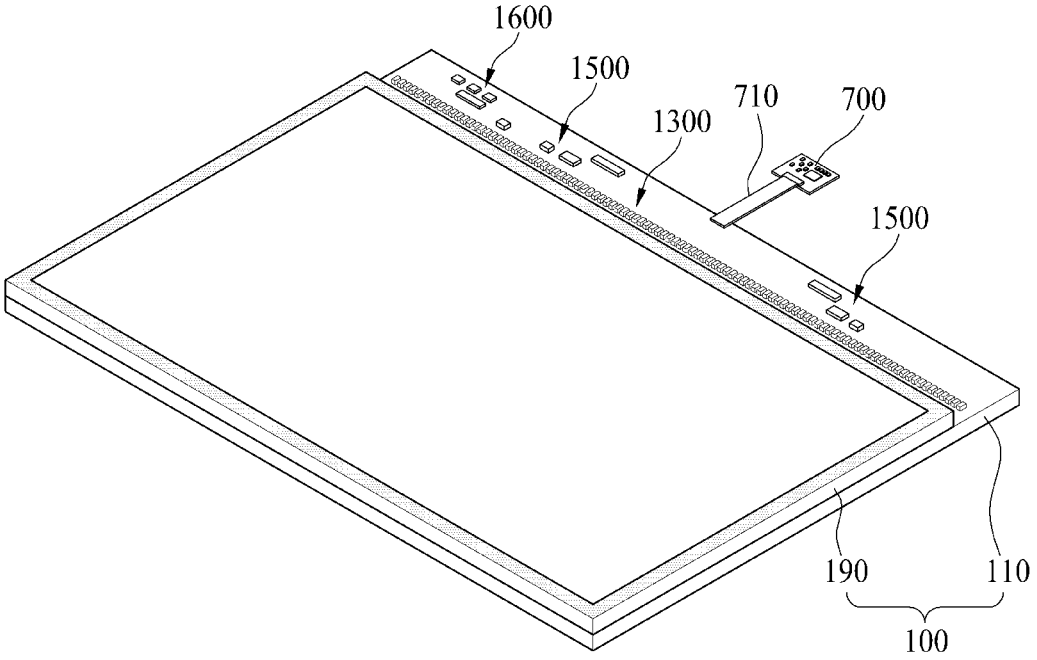
FIG. 12 is a diagram illustrating a light emitting display apparatus according to another aspect of the present disclosure.
Figure 13:
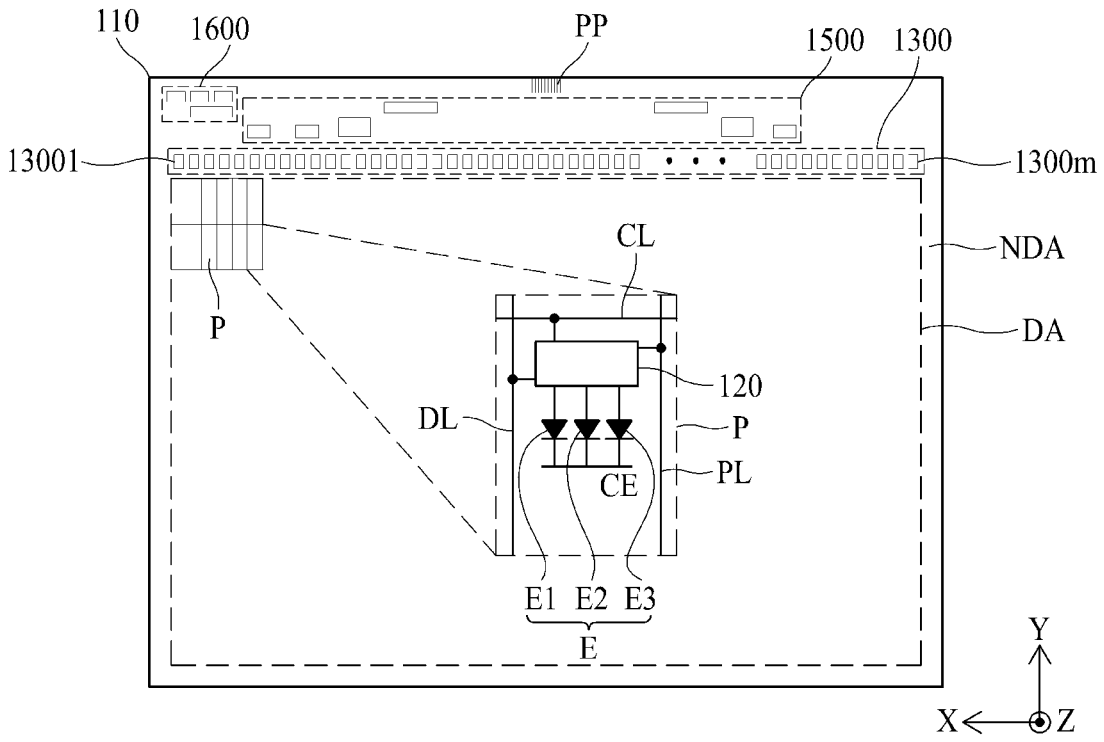
FIG. 13 is a diagram illustrating a substrate illustrated in FIG. 12.

FIG. 12 is a diagram illustrating a light emitting display apparatus according to another aspect of the present disclosure, and FIG. 13 is a diagram illustrating a substrate illustrated in FIG. 12. FIGS. 12 and 13 illustrate an example where each of the timing controller and the power management circuit of the light emitting display apparatus illustrated in FIGS. 1 to 11 is implemented as a microchip, and the microchip is mounted on a substrate of a display panel.

Referring to FIGS. 12 and 13, the light emitting display apparatus according to another aspect of the present disclosure may include a display panel 100, a data driving chip array part 1300, a timing controller chip array part 1500, and a power management chip array part 1600.

The display panel 100 may include a substrate 110 and an opposite substrate 190 and is the same as the display panel of the light emitting display apparatus according to an aspect of the present disclosure. Thus, like reference numerals refer to like elements, and repetitive descriptions of the same elements will be omitted.

The data driving chip array part 1300 may be mounted in a first non-display area (or an upper non-display area) of the substrate 110 and may convert pixel data, supplied from the timing controller chip array part 1500, into a data voltage to supply the data voltage to a corresponding one of first to $m^{th}$ data lines DL. For example, the data driving chip array part 1300 may include a plurality of data driving chips mounted in the first non-display area which is defined between the display area DA and a pad part PP of the substrate 110, and may supply a corresponding data voltage to each of the first to $m^{th}$ data lines DL.

The timing controller chip array part 1500 may be mounted in the first non-display area. The timing controller chip array part 1500 may generate a digital data signal on the basis of an image signal (or a differential signal) supplied from the display driving system 700 through the pad part PP and may provide the digital data signal to the data driving chip array part 1300. That is, the timing controller chip array part 1500 may receive the differential signal input through the pad part PP and may generate a frame-based digital data signal, reference clock, and data start signal from the differential signal. Also, the timing controller chip array part 1500 may perform image processing for image quality improvement on the digital data signal in units of frames and may provide the frame-based digital data signal, on which the image processing has been performed, to the data driving chip array part 1300 in units of at least one horizontal line.

The power management chip array part 1600 may be mounted in the non-display area of the substrate 110 and may output various voltages for displaying an image on each pixel P of the display panel 100 on the basis of an input power supplied from the display driving system 700 through the pad part PP disposed in the substrate 110. According to an aspect, the power management chip array part 1600 may generate a transistor logic voltage, pixel driving power, cathode power, and at least one reference gamma voltage on the basis of the input power.

Figure 14:
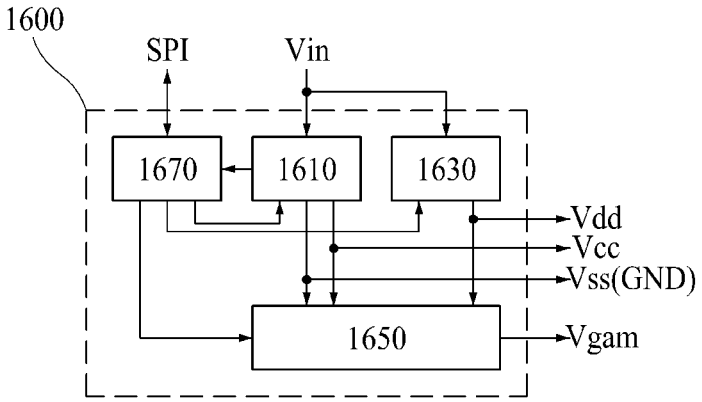
FIG. 14 is a block diagram illustrating a power management chip array part illustrated in FIGS. 12 and 13.

FIG. 14 is a block diagram illustrating the power management chip array part illustrated in FIGS. 12 and 13.

Referring to FIG. 14 in conjunction with FIGS. 12 and 13, the power management chip array part 1600 of the light emitting display apparatus may include a DC-DC converter chip array part which is mounted in the non-display area NDA of the substrate 110 and performs DC-DC conversion on an input power Vin received from the outside to output a converted input power.

The DC-DC converter chip array part may include a logic power chip 1610, a driving power chip 1630, and a gamma voltage generating chip 1650. Here, each of the logic power chip 1610, the driving power chip 1630, and the gamma voltage generating chip 1650 may be a minimum-unit microchip or one chipset and may be a semiconductor packaging device which includes an IC including a plurality of transistors and has a fine size.

The logic power chip 1610 may generate a transistor logic voltage Vcc based on the input power Vin and may provide the transistor logic voltage Vcc to a microchip that requires the transistor logic voltage Vcc. For example, the logic power chip 1610 may decrease (step down) the input power Vin to generate a transistor logic voltage Vcc of 3.3V. Also, the logic power chip 1610 may generate a ground voltage GND based on the input power Vin and provides the ground voltage GND to a microchip that requires the ground voltage GND. Here, the ground voltage GND may be used as cathode power Vss supplied to the cathode electrode CE disposed on the display panel 100. According to an aspect, the logic power chip 1610 may be a DC-DC converter, for example, a step-down converter chip or a buck converter chip, but the present disclosure is not limited thereto.

The driving power chip 1630 may generate pixel driving power VDD based on the input power Vin and may provide the pixel driving power VDD to each pixel P and a microchip that require the pixel driving power VDD. For example, the driving power chip 1630 may generate pixel driving power VDD of 12V. According to an aspect, the driving power chip 1630 may be a DC-DC converter, for example, a step-up converter chip or a boost converter chip, but the present disclosure is not limited thereto.

The gamma voltage generating chip 1650 may receive the transistor logic voltage Vcc from the logic power chip 1610, receive the pixel driving power VDD from the driving power chip 1630, generate at least one reference voltage Vgam, and provide the reference gamma voltage Vgam to the data driving chip array part 1300. For example, through voltage distribution using a plurality of voltage divider resistors connected in series between a low potential terminal to which the transistor logic voltage Vcc is to be supplied and a high potential terminal to which the pixel drive power supply VDD is to be supplied, the gamma voltage generating chip 1650 may output, as the reference gamma voltage Vgam, a distribution voltage of a voltage distribution node between the plurality of voltage divider resistors.

According to an aspect, the power management chip array part 1600 may further include a serial communication chip 1670. Here, the serial communication chip 1670 may be a minimum-unit microchip or one chipset and may be a semiconductor packaging device which includes an IC including a plurality of transistors and has a fine size.

The serial communication chip 1670 may be connected to the display driving system 700 through a connector attached to a serial communication pad disposed at a side of the non-display area of the substrate 110, separately from the pad part PP disposed on the substrate 110. The serial communication chip 1670 may receive a voltage tuning signal supplied from the display driving system 700, restore the received voltage tuning signal back to voltage tuning data, and transmit the voltage tuning data to the dc-dc converter chip array part. For example, the voltage tuning signal may be a signal for tuning a gamma voltage. In this case, the voltage tuning data corresponding to the voltage tuning signal may be provided to the gamma voltage generating chip 1650, and the gamma voltage generating chip 1650 may tune a voltage level of the pixel driving power VDD supplied to the high potential terminal or tune resistance of at least one of the plurality of voltage divider resistors depending on the voltage tuning data.

Figure 15:
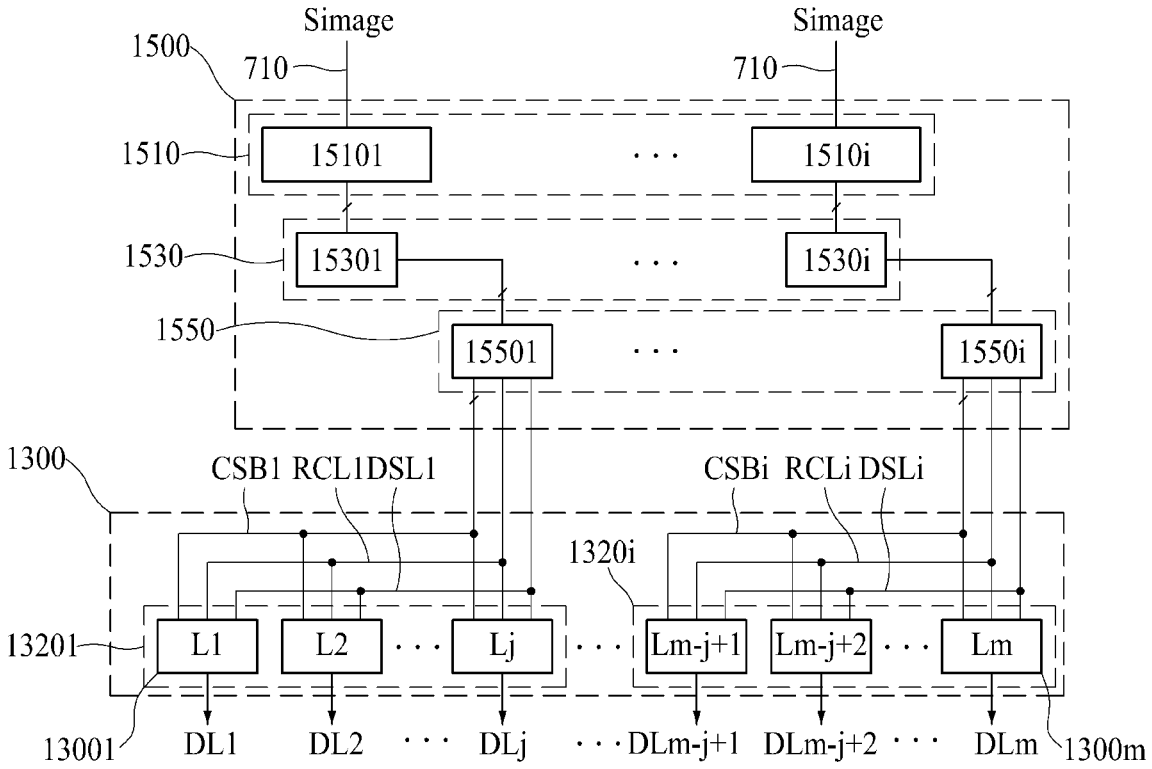
FIG. 15 is a diagram illustrating a timing controller chip array part and a data driving chip array part illustrated in FIGS. 12 and 13.

FIG. 15 is a diagram illustrating the timing controller chip array part and the data driving chip array part illustrated in FIGS. 12 and 13.

Referring to FIG. 15 in conjunction with FIGS. 12 and 13, the timing controller chip array part 1500 of the light emitting display apparatus may include an image signal reception chip array 1510, an image quality improvement chip array 1530, a data control chip array 1550, and a gate control chip 1570.

The image signal reception chip array 1510 may generate a digital data signal, a reference clock, and a data start signal in one frame on the basis of an image signal Simage input from the display driving system 700 through the pad part PP. Here, the image signal Simage may be provided to the image signal reception chip array 1510 through a high-speed serial interface manner, for example, a V-by-One interface manner. In this case, the image signal reception chip array 1510 may receive a digital data signal corresponding to a differential signal for the image signal input from the display driving system 700 through the V-by-One interface manner, generate pixel data corresponding to at least one horizontal line on the basis of the received digital data signal, and generate a reference clock and a data start signal from the differential signal.

According to an aspect, the image signal reception chip array 1510 may include first to $i^{th}$ image signal reception chips 15101 to 1510*i* (here, i is a natural number greater than or equal to two). Here, each of the first to $i^{th}$ image signal reception chips 15101 to 1510*i* may be a minimum-unit microchip or one chipset and may be a semiconductor packaging device which includes an IC including a plurality of transistors and has a fine size.

In order to perform synchronization and data communication between the first to $i^{th}$ image signal reception chips 15101 to 1510*i*, the first image signal reception chip 15101 may be programmed as a master to control overall operations and functions in the image signal reception chip array 1510, and each of the second to $i^{th}$ image signal reception chips 15102 to 1510*i* may be programmed as a slave to operate in synchronization with the first image signal reception chip 15101.

Each of the first to $i^{th}$ image signal reception chips 15101 to 1510*i* may individually receive digital data signals to be supplied to j pixels among differential signals for the image signal Simage transmitted from the display driving system 700 through an interface cable 710, individually generate pixel data to be supplied to the j pixels on the basis of the received digital data signals, and individually generate a reference clock and a data start signal from the differential signals for the image signal Simage. For example, when the interface cable 710 has first to $i^{th}$ lanes, the first image signal reception chip 15101 may individually receive digital data signals corresponding to first to $i^{th}$ pixels from the differential signals for the image signal Simage transmitted from the display driving system 700 through the first lane of the interface cable 710, individually generate pixel data corresponding to the first to $j^{th}$ pixels on the basis of the received digital data signals, and individually generate a reference clock and a data start signal from the differential signals for the image signal Simage. Also, the $i^{th}$ image signal reception chip 1510*i* may individually receive digital data signals corresponding to $m-j+1^{th}$ to $m^{th}$ pixels from the differential signals for the image signal Simage transmitted from the display driving system 700 through the $i^{th}$ lane of the interface cable 710, individually generate pixel data corresponding to the $m-j+1^{th}$ to $m^{th}$ pixels on the basis of the received digital data signals, and individually generate a reference clock and a data start signal from the differential signals for the image signal Simage.

Each of the first to $i^{th}$ image signal reception chips 15101 to 1510*i* may generate display setting data for the timing controller chip array part 1500 from a differential signal of a first frame input through the interface cable 710, store the display setting data in an internal memory, and generate a digital data signal, a reference clock, and a data start signal from differential signals for frames that are sequentially input through the interface cable 710.

According to an aspect, the image signal reception chip array 1510 may be configured with only one image signal reception chip. That is, the first to $i^{th}$ image signal reception chips 15101 to 1510*i* may be integrated into a single integrated image signal reception chip.

The image quality improvement chip array 1530 may receive a frame-based digital data signal from the image signal reception chip array 1510 and may execute a predetermined image quality improvement algorithm to improve the quality of an image corresponding to the frame-based digital data signal.

According to an aspect, the image quality improvement chip array 1530 may include first to $i^{th}$ image quality improvement chips 15301 to 1530*i* connected on a one-to-one basis to the first to $i^{th}$ image signal reception chips 15101 to 1510*i*. The first to $i^{th}$ image quality improvement chips 15301 to 1530*i* may receive digital data signals from the image signal reception chips 1501 to 1510*i* and may execute the predetermined image quality improvement algorithm to improve image quality according to the frame-based digital data signal. Here, each of the first to $i^{th}$ image quality improvement chips 15301 to 1530*i* may be a minimum-unit microchip or one chipset and may be a semiconductor packaging device which includes an IC including a plurality of transistors and has a fine size.

In order to perform synchronization and data communication between the first to $i^{th}$ image quality improvement chips 15301 to 1530*i*, the first image quality improvement chip 15301 may be programmed as a master to control overall operations and functions in the image quality improvement chip array 1530, and each of the second to $i^{th}$ image quality improvement chips 15302 to 1530*i* may be programmed as a slave to operate in synchronization with the first image quality improvement chip 15301.

When the image signal reception chip array 1510 is configured as a single integrated data reception chip, the first to $i^{th}$ image quality improvement chips 15301 to 1530*i* may be integrated into a single integrated image quality improvement chip connected to the integrated data reception chip.

On the basis of the reference clock and the data start signal provided from the image signal reception chip array 1510, the data control chip array 1550 may align a digital data signal with image quality improved by the image quality improvement chip array 1530 to generate and output pixel data corresponding to one horizontal line.

According to an aspect, the data control chip array 1550 may include first to $i^{th}$ data control chips 15501 to 1550*i* connected on a one-to-one basis to the first to $i^{th}$ image quality improvement chips 15301 to 1530*i*. The first to $i^{th}$ data control chips 15501 to 1550*i* may receive the digital data signal with improved image quality from the image quality improvement chips 15301 to 1530*i* and may align the digital data signal to generate and output pixel data, based on the reference clock and the data start signal provided from the image signal reception chip array 1510. Here, each of the first to $i^{th}$ data control chips 15501 to 1550*i* may be a minimum-unit microchip or one chipset and may be a semiconductor packaging device which includes an IC including a plurality of transistors and has a fine size.

In order to perform synchronization and data communication between the first to $i^{th}$ data control chips 15501 to 1550*i*, the first data control chip 15501 may be programmed as a master to control overall operations and functions in the data control chip array 1550, and each of the second to $i^{th}$ data control chips 15502 to 1550*i* may be programmed as a slave to operate in synchronization with the first data control chip 15501.

The first to $i^{th}$ data reception chips 15501 to 1550*i* may individually output pixel data through a serial data communication manner using first to $i^{th}$ common serial data buses CSB1 to CSBi each having a data bus corresponding to the number of bits of the pixel data, individually output the reference clock to first to $i^{th}$ common reference clock lines RCL1 to RCLi, and individually output the data start signal to first to $i^{th}$ data start signal lines DSL1 to DSLi. For example, the first image signal reception chip 15101 may transmit corresponding pixel data, a corresponding reference clock, and a corresponding data start signal through the first common serial data bus CSB1, the first common reference clock line RCL1, and the first data start signal line DSL1. Also, the $i^{th}$ image signal reception chip 1510*i* may transmit corresponding pixel data, a corresponding reference clock, and a corresponding data start signal through the $i^{th}$ common serial data bus CSBi, the $i^{th}$ common reference clock line RCLi, and the $i^{th}$ data start signal line DSLi.

When the image signal reception chip array 1510 is configured as a single integrated data reception chip and the image quality improvement chip array 1530 is configured as a single integrated image quality improvement chip, the first to $i^{th}$ data control chips 15501 to 1550*i* may be integrated into a single integrated data control chip connected to the integrated data reception chip.

As described above, since the timing controller chip array part 1500 is mounted on the substrate 110 of the display panel 100 and is connected to the display driving system 700 through a single interface cable 710, a connection structure between the display panel 100 and the display driving system 700 may be simplified.

According to an aspect, the data driving chip array part 1300 of the light emitting display apparatus may include first to $m^{th}$ data latch chips L1 to Lm. Here, each of the first to $m^{th}$ data latch chips L1 to Lm may be a minimum-unit microchip or one chipset and may be a semiconductor packaging device which includes an IC including a plurality of transistors and has a fine size.

Each of the first to $m^{th}$ data latch chips L1 to Lm may sample and latch (or hold) pixel data transmitted from the data control chip array 1550 of the timing controller chip array part 1500 according to the reference clock on the basis of the data start signal, and may output the received reference clock and the latched pixel data through a serial data communication manner.

The first to $m^{th}$ data latch chips L1 to Lm may be grouped into first to $i^{th}$ data latch groups 13201 to 1320*i*, each of which consists of j data latch chips. On a group basis, the first to $i^{th}$ data latch groups 13201 to 1320*i* may be connected on a one-to-one basis to the first to $i^{th}$ data control chips 15501 to 1550*i*.

On a group basis, the data latch chips grouped into the first to $i^{th}$ data latch groups 13201 to 1320*i* may be connected to the first to $i^{th}$ common serial data buses CSB1 to CSBi in common. For example, each of the first to $j^{th}$ data latch chips L1 to Lj grouped into the first data latch group 13201 may receive corresponding pixel data, a corresponding reference clock, and a corresponding start signal through the first common serial data bus CSB1, the first common reference clock line RCL1, and the first data start signal line DSL1. Also, each of $m-j+1^{th}$ to $m^{th}$ data latch chips Lm−j+1 to Lm grouped into the $i^{th}$ data latch group 1320*i* may receive corresponding pixel data, a corresponding reference clock, and a corresponding data start signal through the $i^{th}$ common serial data bus CSBi, the $i^{th}$ common reference clock line RCLi, and the $i^{th}$ data start signal line DSLi.

When pixel data having a corresponding number of bits is sampled and latched, each of the first to $m^{th}$ data latch chips L1 to Lm may output the received reference clock and the latched pixel data through a serial data communication manner.

According to an aspect, each of the first to $m^{th}$ data latch chips L1 to Lm may include a latch circuit configured to sample and latch pixel data input through a corresponding common serial data bus CSB according to the reference clock in response to the data start signal, a counter circuit configured to count the reference clock and generate a data output signal, and a clock bypass circuit configured to bypass the received reference clock.

Additionally, one data latch chip, one digital-to-analog conversion chip, and one data amp chip for supplying a data voltage to one data line may configure each of the data driving chip groups 13001 to 1300*m* capable of being integrated into a single data driving chip. In this case, the number of chips connected to each of the first to $m^{th}$ data lines DL1 to DLm may decrease by a factor of ⅓.

In the light emitting display apparatus according to another aspect, all circuits for allowing the display panel 100 to display an image corresponding to an image signal supplied from the display driving system 700 may be implemented as microchips mounted on the substrate 110, thereby obtaining the same effect as that of the light emitting display apparatus illustrated in FIGS. 1 to 11. Also, the microchips may be more easily simplified and integrated, and since the light emitting display apparatus is directly connected to the display driving system 700 through only one signal cable 710 or two signal cables, a connection structure between the light emitting display apparatus and the display driving system 700 may be simplified. Accordingly, the light emitting display apparatus according to another aspect may have a single plate shape, and thus, may have an enhanced sense of beauty in design.

As described above, since the light emitting display apparatus according to the aspects of the present disclosure includes the pixel driving chip for sequentially outputting the driving current through the plurality of output terminals, light having a plurality of colors may be respectively emitted in subfields of a unit frame, thereby preventing the occurrence of the color breaking phenomenon.

Moreover, since the light emitting display apparatus according to the aspects of the present disclosure includes the pixel driving chip for alternately supplying the driving current to a plurality of light emitting devices in each of subfields of a unit frame, thereby preventing the occurrence of the color breaking phenomenon.

Moreover, in the light emitting display apparatus according to the aspects of the present disclosure, a plurality of light emitting devices may respectively emit light having a plurality of colors in subfields of a unit frame, thereby enhancing a response time of an image.

Moreover, in the light emitting display apparatus according to the aspects of the present disclosure, the pixel driving chip including one amplifier may drive a plurality of light emitting devices, thereby reducing the manufacturing cost of the light emitting display apparatus.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A light emitting display apparatus comprising: a plurality of pixels provided in a display area of a substrate and each pixel connected to a data line, a clock line, and a pixel driving power line, wherein each pixel includes:

a pixel driving chip connected to the data line, the clock line, and the pixel driving power line to sequentially output a driving current through a plurality of output terminals thereof; and a plurality of light emitting devices respectively connected to the plurality of output terminals and respectively and sequentially receiving the driving current through the plurality of output terminals to emit light of different colors, wherein the pixel driving chip receives digital data signals from the data line and a reference clock signal from the clock line, and sequentially output the driving current based on received the digital data signals and the reference clock signal, and wherein the pixel driving chip includes:

a pixel driving circuit connected to the data line, the clock line, and the pixel driving power line to output, the pixel driving circuit outputting a driving voltage and a cell signal;

a driving current generator converting the driving voltage into the driving current; and a multiplexer sequentially selecting a corresponding output terminal among the plurality of output terminals based on the cell signal to output the driving current through the selected corresponding output terminal, wherein the driving voltage has a voltage level corresponding to the digital data signals supplied from the data line;

wherein the pixel driving circuit respectively receives a serial data signal, a reference clock signal the digital data signals, the reference clock signal, and a pixel driving voltage through the data line, the clock line, and the pixel driving power line, wherein the pixel driving circuit supplies the driving voltage to the driving current generator and supplies the cell signal to the multiplexer, and wherein the digital data signals includes data information and cell information.

2. The light emitting display apparatus of claim 1, wherein the pixel driving chip alternately supplies the driving current to the plurality of light emitting devices in each of subfields of a unit frame.

3. The light emitting display apparatus of claim 1, wherein each pixel driving chip disposed in adjacent pixels among the plurality of pixels outputs the driving current through different output terminals among the plurality of output terminals.

4. The light emitting display apparatus of claim 1, wherein each of adjacent pixels among the plurality of pixels selects one output terminal among the plurality of output terminals in different orders during a unit frame and outputs the driving current through the selected one output terminal.

5. The light emitting display apparatus of claim 1, wherein the pixel driving chip of each pixel supplies the driving current to a light emitting device spaced apart from a light emitting device of an adjacent pixel when the light emitting device of the adjacent pixel emits light.

6. The light emitting display apparatus of claim 1, wherein the pixel driving circuit includes:

a decoder connected to the data line and the clock line to output, the decoder outputting a data signal and an input cell signal;

a digital-to-analog converter connected to the decoder and the pixel driving power line, the digital-to-analog converter outputting the driving voltage; and a cell signal controller receiving the input cell signal from the decoder to supply, the cell signal supplying the cell signal to the multiplexer.

7. The light emitting display apparatus of claim 1, wherein the pixel driving chip determines an order of output terminals through which the driving current is output based on the cell information.

8. The light emitting display apparatus of claim 7, wherein the plurality of light emitting devices sequentially receives the driving current from the pixel driving chip during a unit frame, based on the cell information, to emit light of different colors.

9. The light emitting display apparatus of claim 1, wherein the pixel driving chip previously receives the serial data signal digital data signals including the cell information before the plurality of light emitting devices is driven.

10. The light emitting display apparatus of claim 9, wherein the pixel driving circuit includes a cell information storage unit storing the cell information included in the previously received digital data signals.

11. The light emitting display apparatus of claim 10, wherein the pixel driving chip receives the digital data signals including the cell information, when the plurality of light emitting devices is driven.

12. The light emitting display apparatus of claim 11, wherein the decoder generates a field pulse signal based on the reference clock signal and supplies the field pulse signal to the cell signal controller.

13. The light emitting display apparatus of claim 12, wherein the cell signal controller generates different cell signals respectively corresponding to subfields of a unit frame based on the field pulse signal and the cell signal stored in the cell information storage unit and supplies a corresponding cell signal to the multiplexer in each of the subfields.

14. The light emitting display apparatus of claim 12, wherein the cell signal controller outputs a cell signal changed in a predetermined order based on the input cell signal and the field pulse signal.

15. A light emitting display apparatus comprising: a plurality of pixels disposed in a display area;

a pixel driving chip disposed in each pixel and connected to a data line, a clock line and a pixel driving power line, and sequentially outputting a driving current through a plurality of output terminals of each pixel; and a plurality of light emitting devices respectively connected to the plurality of output terminals and sequentially receiving the driving current through the plurality of output terminals to emit light of different colors in each subfield within a unit frame, wherein the pixel driving chip receives digital data signals from the data line and a reference clock signal from the clock line, and sequentially output the driving current based on received the digital data signals and the reference clock signal, and wherein the pixel driving chip includes:

a pixel driving circuit connected to the data line, the clock line, and the pixel driving power line to output, the pixel driving circuit outputting a driving voltage and a cell signal;

a driving current generator converting the driving voltage into the driving current;

and a multiplexer sequentially selecting a corresponding output terminal among the plurality of output terminals based on the cell signal to output the driving current through the selected corresponding output terminal, wherein the driving voltage has a voltage level corresponding to the digital data signals supplied from the data line;

wherein the pixel driving circuit respectively receives a serial data signal, a reference clock signal the digital data signals, the reference clock signal, and a pixel driving voltage through the data line, the clock line, and the pixel driving power line, and wherein the pixel driving circuit to supply supplies the driving voltage to the driving current generator and to supply supplies the cell signal to the multiplexer, wherein the digital data signals includes data information and cell information.

16. The light emitting display apparatus of claim 15, wherein the pixel driving circuit includes:

a decoder connected to the data line and the clock line to output, the decoder outputting a data signal and an input cell signal;

a digital-to-analog converter connected to the decoder and the pixel driving power line to output, the digital-to-analog converter outputting the driving voltage; and a cell signal controller receiving the input cell signal from the decoder to supply, the cell signal supplying the cell signal to the multiplexer.

17. The light emitting display apparatus of claim 15, wherein the pixel driving chip determines an order of output terminals through which the driving current is output based on the cell information.

18. The light emitting display apparatus of claim 15, wherein the pixel driving circuit includes a cell information storage unit storing the cell information included in the previously received serial data signal digital data signals.

19. The light emitting display apparatus of claim 16, wherein the decoder generates a field pulse signal based on the reference clock signal and supplies the field pulse signal to the cell signal controller.

20. The light emitting display apparatus of claim 16, wherein the cell signal controller generates different cell signals respectively corresponding to subfields of a unit frame based on the field pulse signal and the cell signal stored in the cell information storage unit and supplies a corresponding cell signal to the multiplexer in each subfield.

21. The light emitting display apparatus of claim 20, wherein the cell signal controller outputs a cell signal changed in a predetermined order based on the input cell signal and the field pulse signal.

* * * * *